US009306282B2

(12) United States Patent
Komulainen et al.

(10) Patent No.: US 9,306,282 B2
(45) Date of Patent: Apr. 5, 2016

(54) ANTENNA ARRANGEMENT

(71) Applicant: Nokia Technologies Oy, Espoo (FI)

(72) Inventors: Mikko S. Komulainen, Oulu (FI); Sami Hienonen, Oulu (FI); Tommi Lepisto, Kempele (FI)

(73) Assignee: Nokia Technologies Oy, Espoo (FI)

( * ) Notice: Subject to any disclaimer, the term of this patent is extended or adjusted under 35 U.S.C. 154(b) by 0 days.

(21) Appl. No.: 14/714,528

(22) Filed: May 18, 2015

(65) Prior Publication Data

US 2015/0380819 A1 Dec. 31, 2015

Related U.S. Application Data

(63) Continuation of application No. 13/630,018, filed on Sep. 28, 2012, now Pat. No. 9,035,830.

(51) Int. Cl.

| | |
|---|---|
| ***H01Q 1/24*** | (2006.01) |
| ***H01Q 5/20*** | (2015.01) |
| ***H01Q 9/04*** | (2006.01) |

(52) U.S. Cl.

CPC ... *H01Q 5/20* (2015.01); *H01Q 9/04* (2013.01)

(58) Field of Classification Search

CPC ..... H01Q 1/243; H01Q 1/521; H01Q 21/28; H01Q 5/371; H01Q 9/42

See application file for complete search history.

(56) References Cited

U.S. PATENT DOCUMENTS

| | | | | |
|---|---|---|---|---|
| 4,584,585 A | 4/1986 | Marko et al. | 343/702 | |
| 5,173,715 A | 12/1992 | Rodal et al. | 343/795 | |
| 6,339,402 B1 * | 1/2002 | McKivergan | H01Q 1/243 | 343/700 MS |
| 6,850,196 B2 * | 2/2005 | Wong | H01Q 1/243 | 343/702 |
| 6,914,565 B2 * | 7/2005 | Shikata | H01Q 9/0421 | 343/700 MS |
| 6,977,616 B2 * | 12/2005 | Yuanzhu | H01Q 5/378 | 343/700 MS |
| 7,307,591 B2 | 12/2007 | Zheng | 343/702 | |
| 7,696,928 B2 | 4/2010 | Rowell | 343/700 MS | |

(Continued)

FOREIGN PATENT DOCUMENTS

| | | |
|---|---|---|
| EP | 1 760 833 A1 | 3/2007 |
| GB | 2 396 484 A | 6/2004 |

(Continued)

OTHER PUBLICATIONS

Chebihi et al., "A Novel Isolation Technique for Closely Spaced PIFAs for UMTS Mobile Phones", IEEE Antennas and Wireless Propagation Letters, vol. 7, 2008, pp. 665-669.

(Continued)

*Primary Examiner* — Tho G Phan

(74) *Attorney, Agent, or Firm* — Harrington & Smith

(57) ABSTRACT

An apparatus for antenna arrangement isolation is described. The apparatus includes a first antenna element (for example, a CMMB TV antenna) having a first radiator component and a second antenna element (for example, a cellular antenna) having a second radiator component. A first portion of the first radiator component is adjacent to a second portion of the second radiator component. The second radiator component is configured with at least one operational frequency range. The first portion of the first radiator corresponds to at least one minimum electric field region of at least one resonant frequency of the first radiator. The at least one resonant frequency of the first radiator overlaps with the at least one operational frequency range. Methods, Apparatus and Computer readable media for providing the antenna arrangement are also described.

16 Claims, 29 Drawing Sheets

(56) References Cited

U.S. PATENT DOCUMENTS

| | | | | |
|---|---|---|---|---|
| 7,701,401 | B2 | 4/2010 | Suzuki et al. | 343/702 |
| 7,830,320 | B2 | 11/2010 | Shamblin et al. | 343/747 |
| 7,864,117 | B2 | 1/2011 | Aurinsalo et al. | 343/700 MS |
| 7,973,726 | B2 * | 7/2011 | Tseng | H01Q 1/243 343/700 MS |
| 8,063,827 | B2 * | 11/2011 | Hotta | H01Q 1/243 343/700 MS |
| 9,054,422 | B2 * | 6/2015 | Tu | H01Q 1/48 343/700 MS |
| 2003/0193437 | A1 | 10/2003 | Kangasvieri et al. | 343/702 |
| 2006/0038736 | A1 | 2/2006 | Hui et al. | 343/835 |
| 2006/0044195 | A1 | 3/2006 | Arkko et al. | 343/702 |
| 2008/0297419 | A1 | 12/2008 | Dou et al. | 343/702 |
| 2009/0014933 | A1 | 1/2009 | Liu et al. | 269/56 |
| 2011/0169703 | A1 | 7/2011 | Schlub et al. | 343/702 |
| 2011/0193754 | A1 | 8/2011 | Schlub et al. | 343/702 |

FOREIGN PATENT DOCUMENTS

| | | | |
|---|---|---|---|
| WO | WO 99/43044 | | 8/1999 |
| WO | WO 2010/002521 | A2 | 1/2010 |
| WO | WO 2010/095820 | A2 | 8/2010 |
| WO | WO 2011/087177 | A1 | 7/2011 |
| WO | WO 2011/140653 | A1 | 11/2011 |
| WO | WO 2011/154943 | A1 | 12/2011 |

OTHER PUBLICATIONS

Mak et al., "Isolation Enhancement Between Two Closely Packed Antennas", IEEE Transactions on Antennas and Propagation, vol. 56, No. 11, Nov. 2008, pp. 3411-3419.

Esser et al., "Improved Antenna Isolation in Transmit/Receive Applications", German Microwave Conference, GeMiC 2006 (5 pages).

* cited by examiner

ANTENNA ARRANGEMENT

CROSS REFERENCE TO RELATED APPLICATIONS

This application is a continuation of U.S. application Ser. No. 13/630,018, filed on Sep. 28, 2012, and incorporated by reference herein in its entirety.

TECHNICAL FIELD

The exemplary and non-limiting embodiments relate generally to wireless communication systems, methods, devices and computer programs and, more specifically, relate to antenna arrangement isolation.

BACKGROUND

This section is intended to provide a background or context. The description herein may include concepts that could be pursued, but are not necessarily ones that have been previously conceived or pursued. Therefore, unless otherwise indicated herein, what is described in this section is not prior art to the description and claims in this application and is not admitted to be prior art by inclusion in this section.

The following abbreviations that may be found in the specification and/or the drawing figures are defined as follows:

CMMB China multimedia mobile broadcasting

EG equivalent gain f(n)cel (n)th frequency mode for a cellular antenna, e.g., f1cel f(n)tv (n)th frequency mode for a TV antenna, e.g., f1tv ISDB-T integrated services digital broadcasting terrestrial LNA low-noise amplifier PWB printed wiring board RF radio frequency S21 scattering parameter Modern mobile devices are increasing the number of antennas within the device while simultaneously reducing the size of the mobile devices themselves. However, close proximity of antennas risks power leakage between radio systems which may in turn cause various communication problems, such as de-sensing or jamming of receivers. Thus, there is a need for compact antenna solutions with suitable performance that properly work in very close proximity to each other.

SUMMARY

The below summary section is intended to be merely exemplary and non-limiting.

The foregoing and other problems are overcome, and other advantages are realized, by the use of the exemplary embodiments.

In a first aspect thereof an exemplary embodiment provides an apparatus for antenna isolation improvement. The apparatus includes a first antenna element (such as a CMMB TV antenna for example) having a first radiator component and a second antenna element (such as a cellular antenna for example) having a second radiator component. A first portion of the first radiator component is adjacent to a second portion of the second radiator component. The first portion of the first radiator component is located at a separation distance from the second portion of the second radiator component. The second radiator component is configured with at least one operational frequency range. The first portion of the first radiator corresponds to at least one minimum electric field region of at least one resonant frequency of the first radiator. The at least one resonant frequency of the first radiator overlaps with the at least one operational frequency range.

In another aspect thereof an exemplary embodiment provides a method for providing a closely, spaced antenna arrangement. The method includes selecting a first (for example, cellular) antenna element comprising a first radiator component. The first radiator component is configured with at least one operational frequency range. The method also includes selecting a second (for example, television) antenna element comprising a second radiator component based at least in part on the operational frequency range of the cellular antenna element. The method also includes positioning the cellular antenna element and the television antenna element such that a first portion of the first radiator component is adjacent to a second portion of the second radiator component. The second portion of the second radiator corresponds to at least one minimum electric field region of at least one resonant frequency of the second radiator. The at least one resonant frequency of the second radiator overlaps with the at least one operational frequency range.

In a further aspect thereof an exemplary embodiment provides an apparatus for providing a closely spaced antenna arrangement. The apparatus includes at least one processor and at least one memory storing computer program code. The at least one memory and the computer program code are configured to, with the at least one processor, cause the apparatus to perform actions. The actions include selecting a first (for example, cellular) antenna element comprising a first radiator component. The first radiator component is configured with at least one operational frequency range. The actions also include selecting a second (for example, television) antenna element comprising a second radiator component based at least in part on the operational frequency range of the cellular antenna element. The actions also include positioning the cellular antenna element and the television antenna element such that a first portion of the first radiator component is adjacent to a second portion of the second radiator component. The second portion of the second radiator corresponds to at least one minimum electric field region of at least one resonant frequency of the second radiator. The at least one resonant frequency of the second radiator overlaps with the at least one operational frequency range.

In another aspect thereof an exemplary embodiment provides a computer readable medium for providing a closely spaced antenna arrangement. The computer readable medium is tangibly encoded with a computer program executable by a processor to perform actions. The actions include selecting a first (for example, cellular) antenna element comprising a first radiator component. The first radiator component is configured with at least one operational frequency range. The actions also include selecting a second (for example, television) antenna element comprising a second radiator component based at least in part on the operational frequency range of the cellular antenna element. The actions also include positioning the cellular antenna element and the television antenna element such that a first portion of the first radiator component is adjacent to a second portion of the second radiator component. The second portion of the second radiator corresponds to at least one minimum electric field region of at least one resonant frequency of the second radiator. The at least one resonant frequency of the second radiator overlaps with the at least one operational frequency range.

In a further aspect thereof an exemplary embodiment provides an apparatus for providing a closely spaced antenna arrangement. The apparatus includes means for selecting a first (for example, cellular) antenna element comprising a first radiator component. The first radiator component is configured with at least one operational frequency range. The apparatus also includes means for selecting a second (for example, television) antenna element comprising a second radiator component based at least in part on the operational frequency range of the cellular antenna element. The apparatus also includes means for positioning the cellular antenna element and the television antenna element such that a first portion of the first radiator component is adjacent to a second portion of the second radiator component. The second portion of the second radiator corresponds to at least one minimum electric field region of at least one resonant frequency of the second radiator. The at least one resonant frequency of the second radiator overlaps with the at least one operational frequency range.

BRIEF DESCRIPTION OF THE DRAWINGS

The foregoing and other aspects of exemplary embodiments are made more evident in the following Detailed Description, when read in conjunction with the attached Drawing Figures, wherein.

DETAILED DESCRIPTION

Figure 1B:
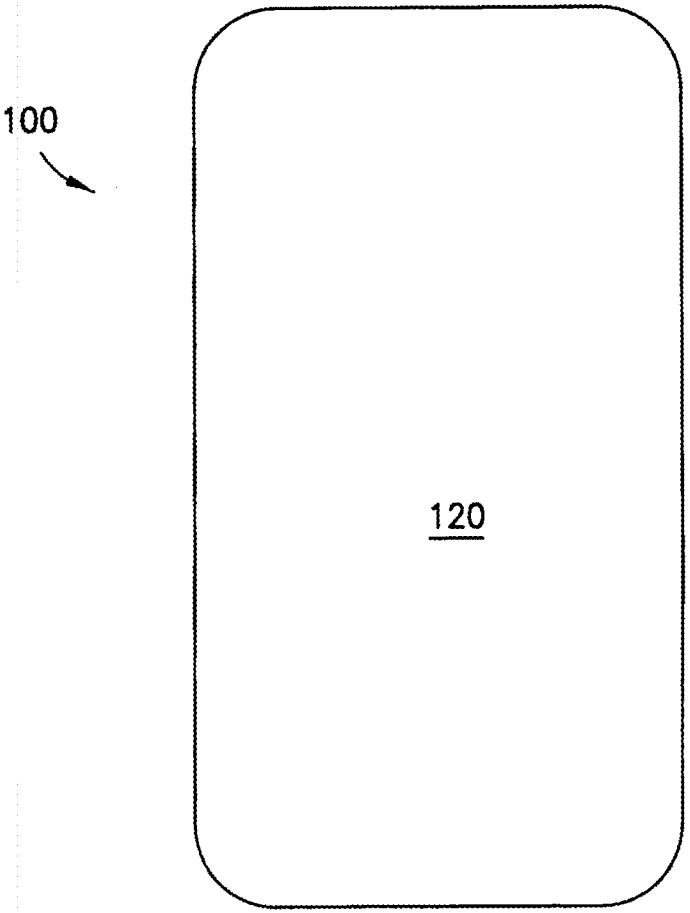
FIGS. 1A-1B, collectively referred to as FIG. 1, show various images of a mobile device having an antenna arrangement in accordance with an exemplary embodiment.
Figure 1A:
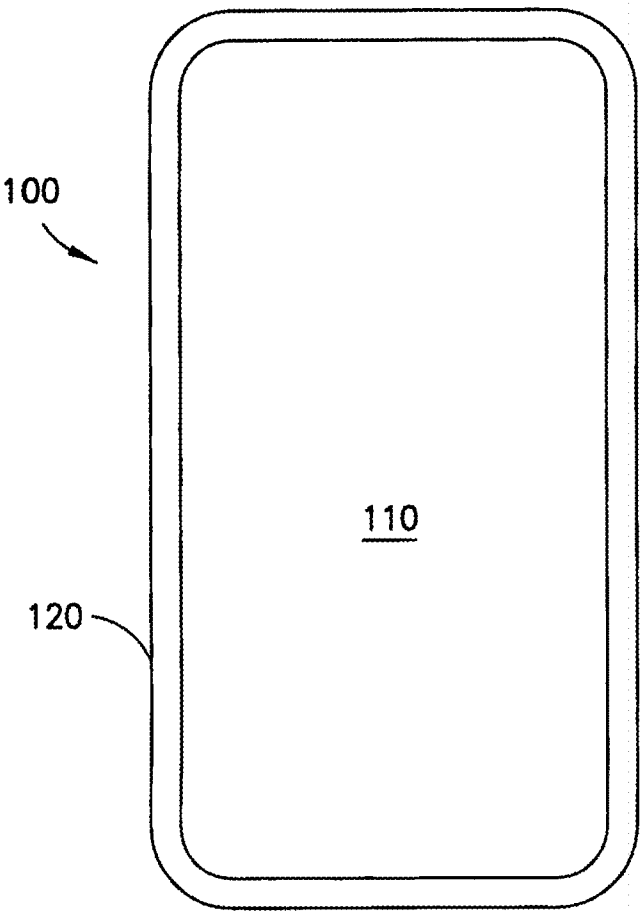

FIGS. 1A-1B, collectively referred to as FIG. 1, show various images of a portable electronic device, for example, a mobile phone having an antenna arrangement in accordance with an exemplary embodiment. FIG. 1A shows a front face of a mobile device 100 having a display 110 and a cover 120. FIG. 1B shows the back of the mobile device 100. In other exemplary embodiments the portable electronic device may be, and not limited to, at least one of a mobile phone, a smartphone, a laptop computer, a tablet computer, a personal digital assistant (PDA), a digital camera, a digital camcorder, a music player, a multimedia player, and a radio device.

Figure 2:
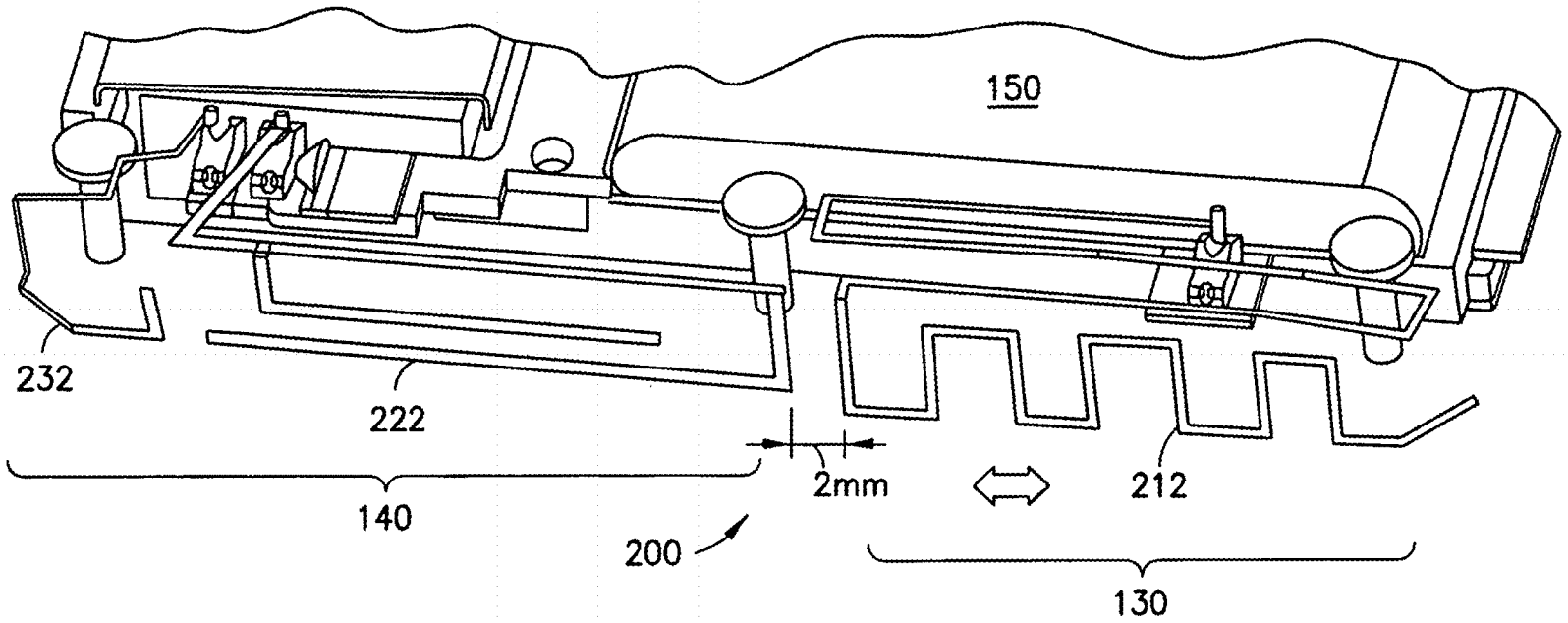
FIG. 2 displays the antenna arrangement attached to the mechanics of a mobile device.

FIG. 2 displays a close-up view of antenna arrangement 200 attached to the mechanics of the mobile device 100. In this view the internal mechanics 150 of the mobile device 100 can be seen. Additionally, a first antenna 130, configured for TV reception and a second antenna 140, configured for cellular reception and transmission are visible. Radiator elements 222, 232 of the second antenna 140 are shown. Radiator element 232 is a parasitic cellular radiator element which is only coupled at one end thereof to the ground plane provided by the printed wiring board (PWB), the second end of the radiator being left open. Radiator element 222 is a fed or driven antenna element, in other words at least one radio frequency circuit (receiver/transmitter/transceiver) is coupled to a feed terminal of this antenna element. Radiator element 212 of the first antenna 130 is also shown and radiator element 212 is also a fed or driven antenna element, however, in this example a different RF circuit is coupled to the radiator element 212, than the RF circuit coupled to the radiator element 222. The radiator element 222 has a portion which is approximately 2 mm from a portion of radiator element 212 of the first antenna 130. Due to this close proximity, if radiator elements 212, 222 are not properly selected the isolation between the two antennas suffers. However, the exemplary embodiment ensures the isolation of the antennas and enables antenna arrangement 200 to operate in critical frequencies.

Figure 3:
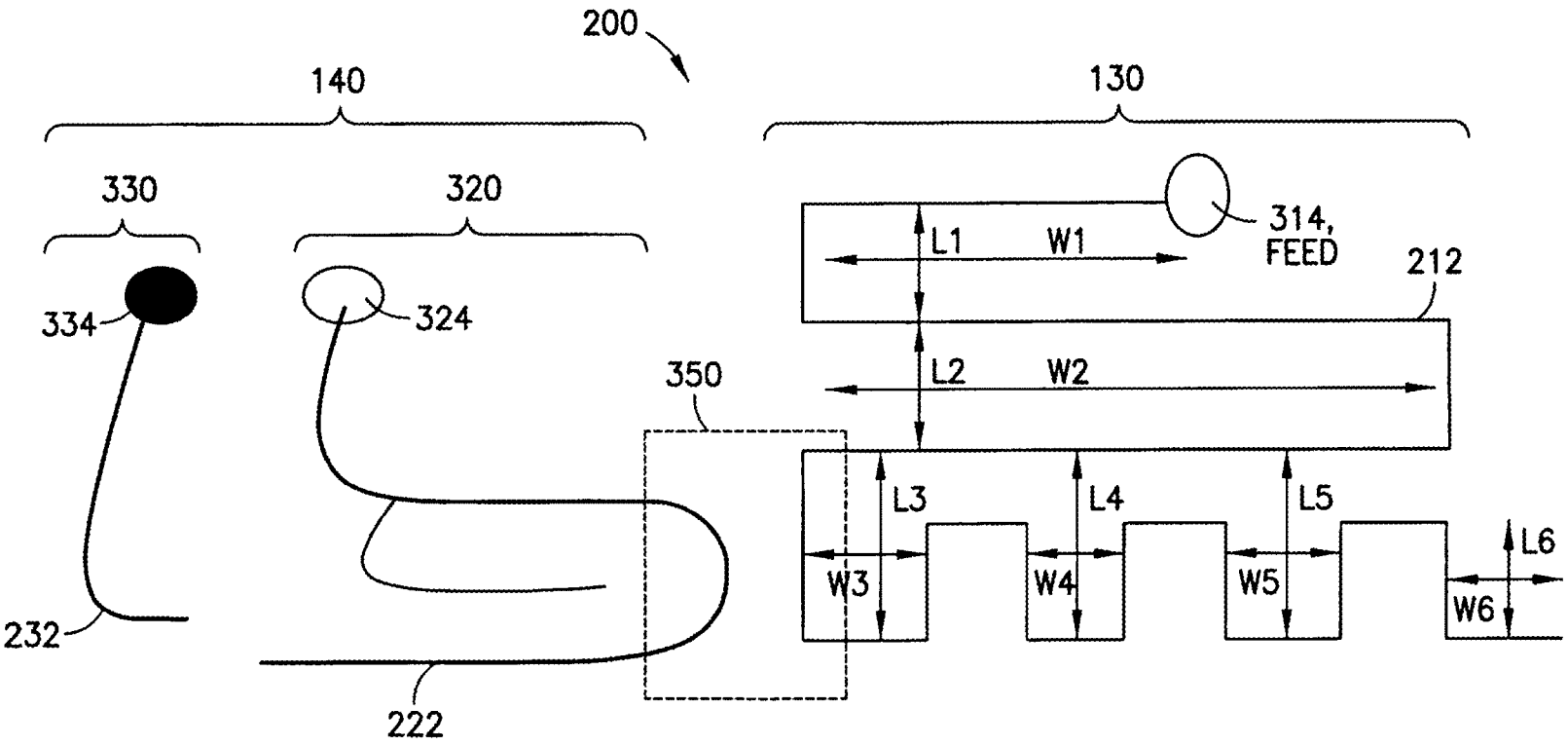
FIG. 3 illustrates an isolation area and various parameters of an antenna arrangement in accordance with the exemplary embodiment.

FIG. 3 illustrates an isolation area 350 and various parameters of the antenna arrangement 200 in accordance with the exemplary embodiment. The antenna arrangement 200 includes the first antenna 130 configured to receive TV signals, in this non-limiting embodiment, the first antenna 130 may also be referred to as a TV antenna 130. The antenna arrangement 200 also includes the second antenna 140 configured to receive cellular signals using a single feed monopole antenna 320 and a parasitic antenna 330, in this non-limiting embodiment, the second antenna 140 may also referred to as a cellular antenna 140. The antenna 140 and antenna 130 are adjacent to each other as no intervening components physically separate the two antennas.

It should also be appreciated that in an example embodiment, that a separation distance between a portion of the first antenna 130 and a portion of the second antenna 140, as an example and not limited to, may be of the order of 2 to 15 mm and that this could be considered to have a separation distance or isolation area 350 which provides very close proximity between the portion of the first antenna 130 and the portion of the second antenna 140. Whether the separation distance or isolation area 350 is considered to be in close proximity is dependent on antenna type, shape and size of the antenna element(s), and also on operational frequency bands of each of the antennas.

The TV antenna 130 has a feed point 314 and a radiator element 212. The radiator may be described with various measurements of the antenna as total length and other physical characteristics. For illustration various length and width measurements have been added (such as, L1, W1, L2, W2, etc.). Note that a TV antenna 130 may include more or less of the various meandering sections shown.

The cellular antenna 140 includes a first feed point 324 and a first radiator element 222 serving the monopole antenna 320 and a short circuit point 334 of a second radiator element 232 serving the parasitic antenna 330. Isolation area 350 highlights a region including both radiator element 222 and radiator element 212. Due to the close proximity of both radiator elements 212, 222, there is a potential for a transfer of energy between the antennas 130, 140. This coupling can reduce the isolation of each antenna 130, 140 and reduce the ability of the antenna 130, 140 to receive signals.

In the above non-limiting embodiment, the TV antenna 130 may be a CMMB antenna, an ISDB-T antenna or other antenna type suitable to the local technical environment.

In the above non-limiting embodiment, the cellular antenna 140 has resonant frequencies (such as f1cel, f2cel and f3cel for example) which provide coverage for the cellular bands. The cellular antenna 140 may be a GSM900/1800/1900 antenna, a TD-SCDMA 34/39 antenna, WCDMA antenna, LTE antenna or other antenna type suitable to the local technical environment as described also in the previous paragraph.

In the current, non-limiting embodiment, the first antenna 130 is configured to receive TV signals and the second antenna 140 is configured to transmit and receive cellular signals. In an example embodiment, at least one of the first antenna 130 and the second antenna 140 may be configured to transmit and receive, transmit only, and/or receive only radio frequencies. The first antenna 130 and the second antenna 140 may be configured to use other frequency bands, transmission protocols and/or radio access technologies (RATs). For example the first antenna 130 could be configured to operate in a different frequency band (cellular or non-cellular) to that of the second antenna 140. Alternatively, the first antenna 130 could be configured to operate in any protocol, cellular or non-cellular, for example, and not limited to, Bluetooth (BT), wireless local area network (WLAN), global positioning system (GPS), frequency modulation (FM) reception and/or transmission, amplitude modulation (AM), digital video broadcasting handheld (DVB-H), worldwide interoperability for microwave access (WiMax), digital radio mundiale (DRM), digital audio broadcast (DAB), long term evolution (LTE), global system for mobile communications (GSM), wideband code division multiple access (WCDMA), personal communications network (PCN/DCS), personal communications service (PCS), time division synchronous code division multiple access (TD-SCDMA) and ultra wideband (UWB).

Figure 4:
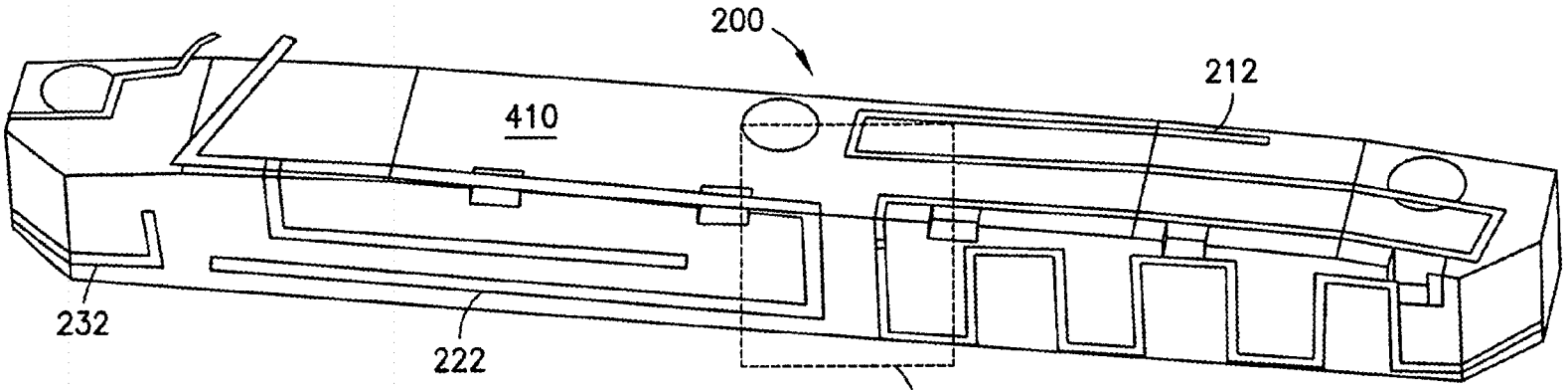
FIG. 4 shows an isolation area of another antenna arrangement in accordance with the exemplary embodiment.

FIG. 4 shows an isolation area 350 of the antenna arrangement 200 in accordance with the exemplary embodiment. Radiator elements 222, 232, 212 are shown in relation to a plastic or dielectric support frame 410 of a mobile device. Isolation area 350 indicates the region where radiator elements 222 and 212 may couple due to their close proximity to each other.

The resonant frequencies of an antenna influence electric and magnetic field distributions of standing waves in the radiator. Various exemplary embodiments use this feature so that an antenna radiator is selected so that its resonances do not have standing waves causing electric field maxima in an area near another antenna at or near operational frequencies of the other antenna, for example, in area 350. By preventing electric field maxima, sufficient isolation between the antennas is ensured.

Figure 5:
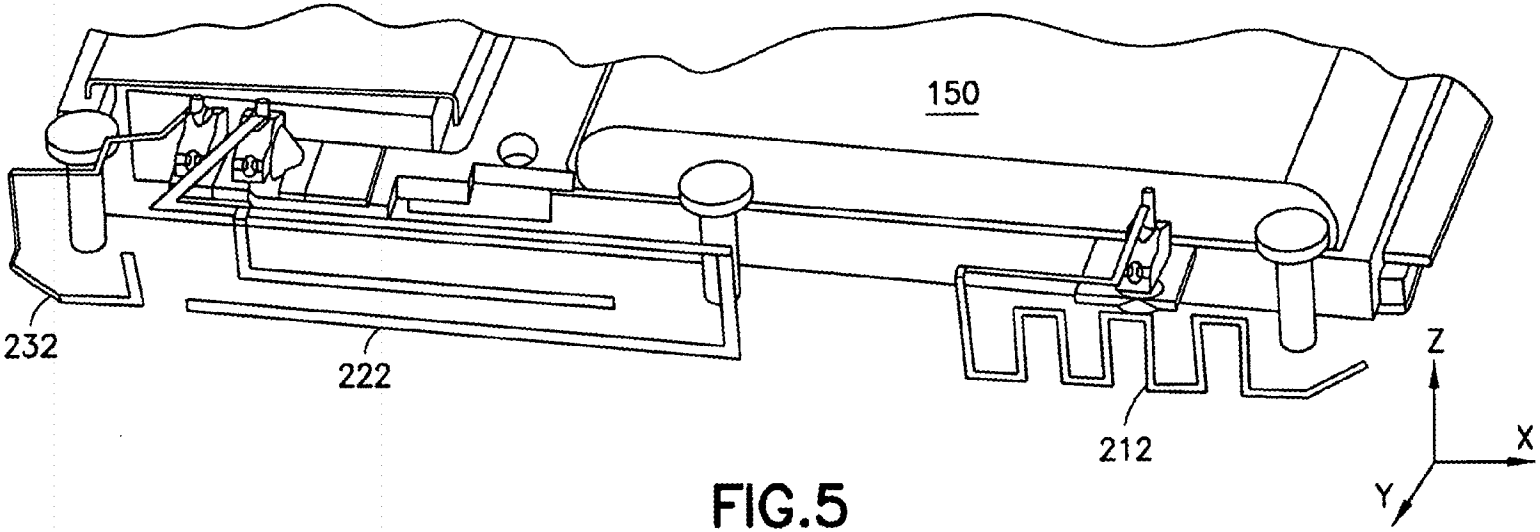
FIG. 5 displays another view of the antenna arrangement in accordance with the exemplary embodiment.
Figure 6:
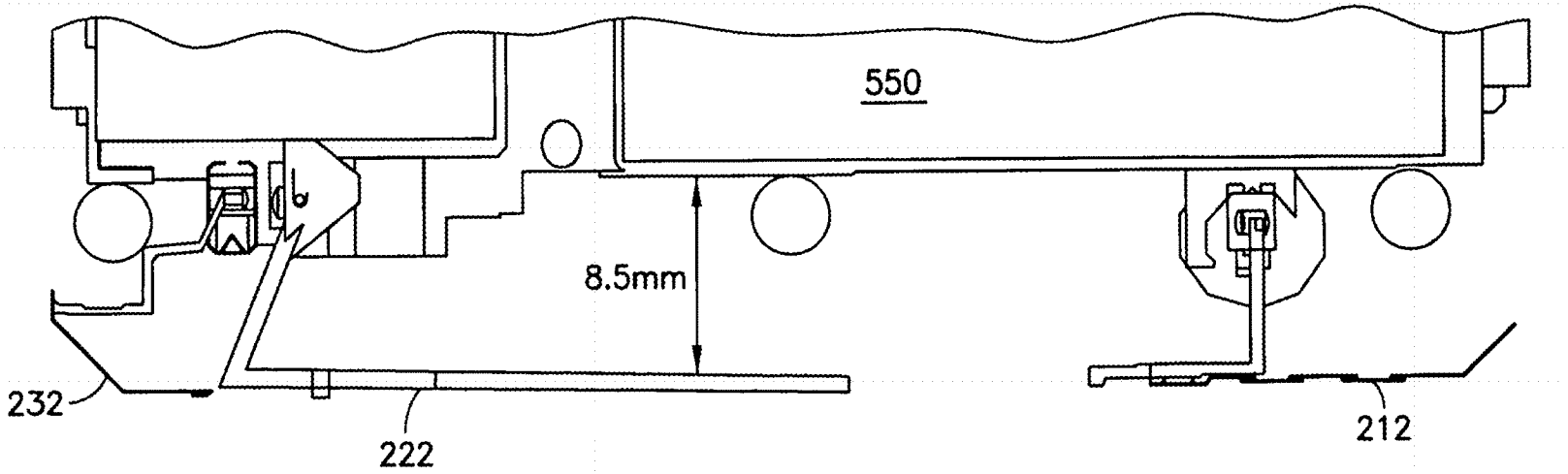
FIG. 6 displays a close-up view of the antenna arrangement in accordance with the exemplary embodiment.

FIG. 5 displays another view of the antenna arrangement and FIG. 6 displays another close-up view of the antenna arrangement. As seen in FIG. 6, a radiator element 222 of the cellular antenna 140 and the radiator element 212 of the TV antenna 130 are spaced 8.5 mm in the y-direction from the internal mechanics 150. A ground plane may be provided by one layer of internal mechanics 150 (such as by a PWB for example). The spacing of the radiator elements 212, 222, 232 may be measured from the ground plane.

As shown in FIGS. 4-6, the space available for positioning the TV antenna 130 and the cellular antenna 140 is limited. Conventional approaches to providing isolation operate by increasing the distance between antennas and/or placing additional elements within the antenna arrangement (such as filters, RF switches, etc.). However, due to the limited space (and costs) such approaches are not desirable. In contrast, various exemplary embodiments, such as that shown in FIG.

4, allow antenna arrangements to function within the ever smaller envelope of a portable electronic device without requiring additional components.

Other conventional techniques for isolation use special grounding arrangements or split the ground plane. A special grounding arrangement reduces integration density and adds complexity and cost to the arrangement. Splitting the ground plane does the same. In addition for devices having a large touch screen (as many modern mobile devices do), this might necessitate splitting of the display module which is impractical.

Figure 7:
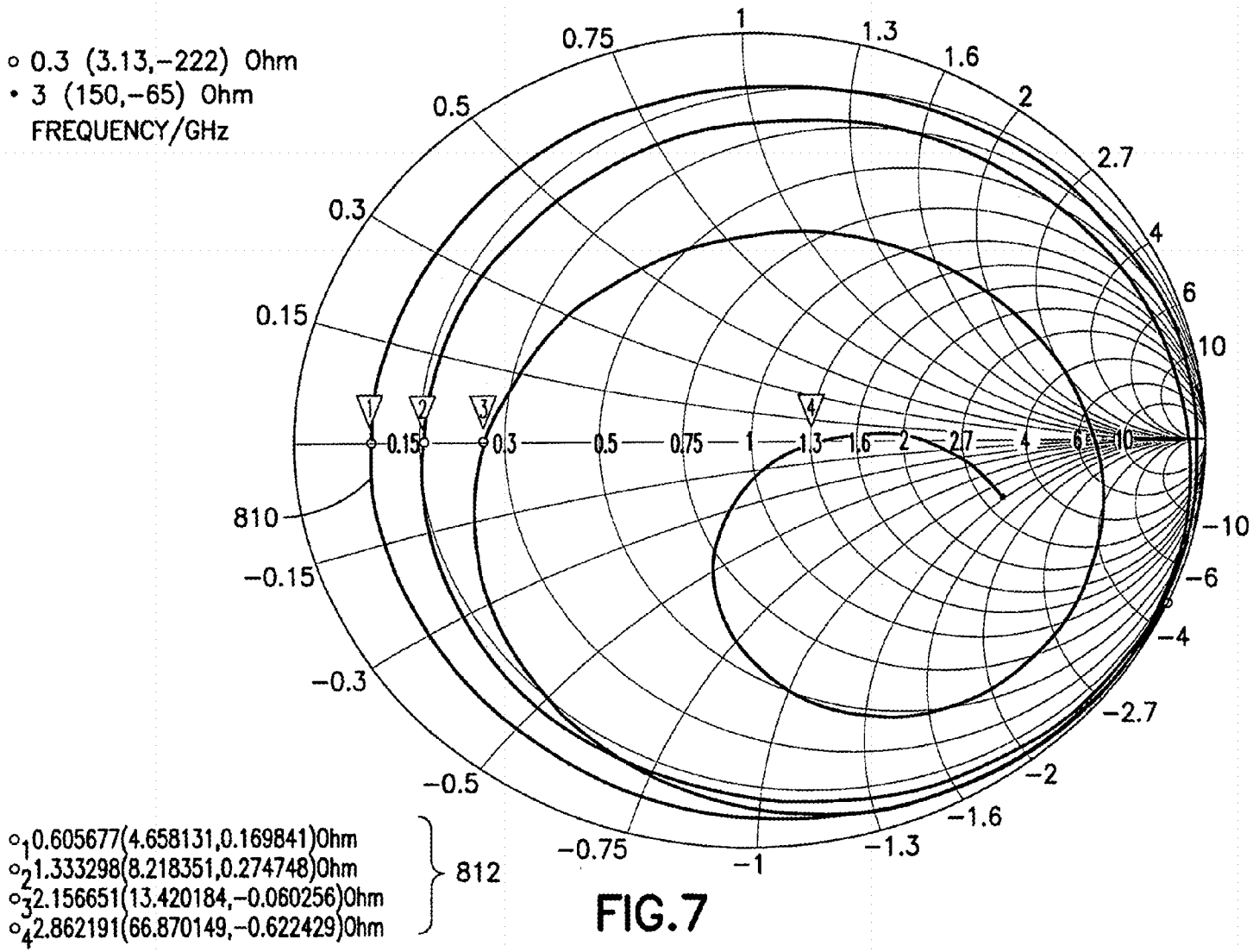
FIG. 7 is a graph of various resonant frequencies of a TV antenna in accordance with the exemplary embodiment.

FIG. 7 is a graph of various resonant frequencies of a TV antenna in accordance with the exemplary embodiment. The S-parameter impedance is shown by curve 810. Resonance frequencies are indicated in legend elements 812. The first four resonant frequencies of the TV antenna are as follows: f1tv at approximately 605 MHz, f2tv at approximately 1,330 MHz, f3tv at approximately 2,160 MHz and f4tv at approximately 2,860 MHz.

Figure 8:
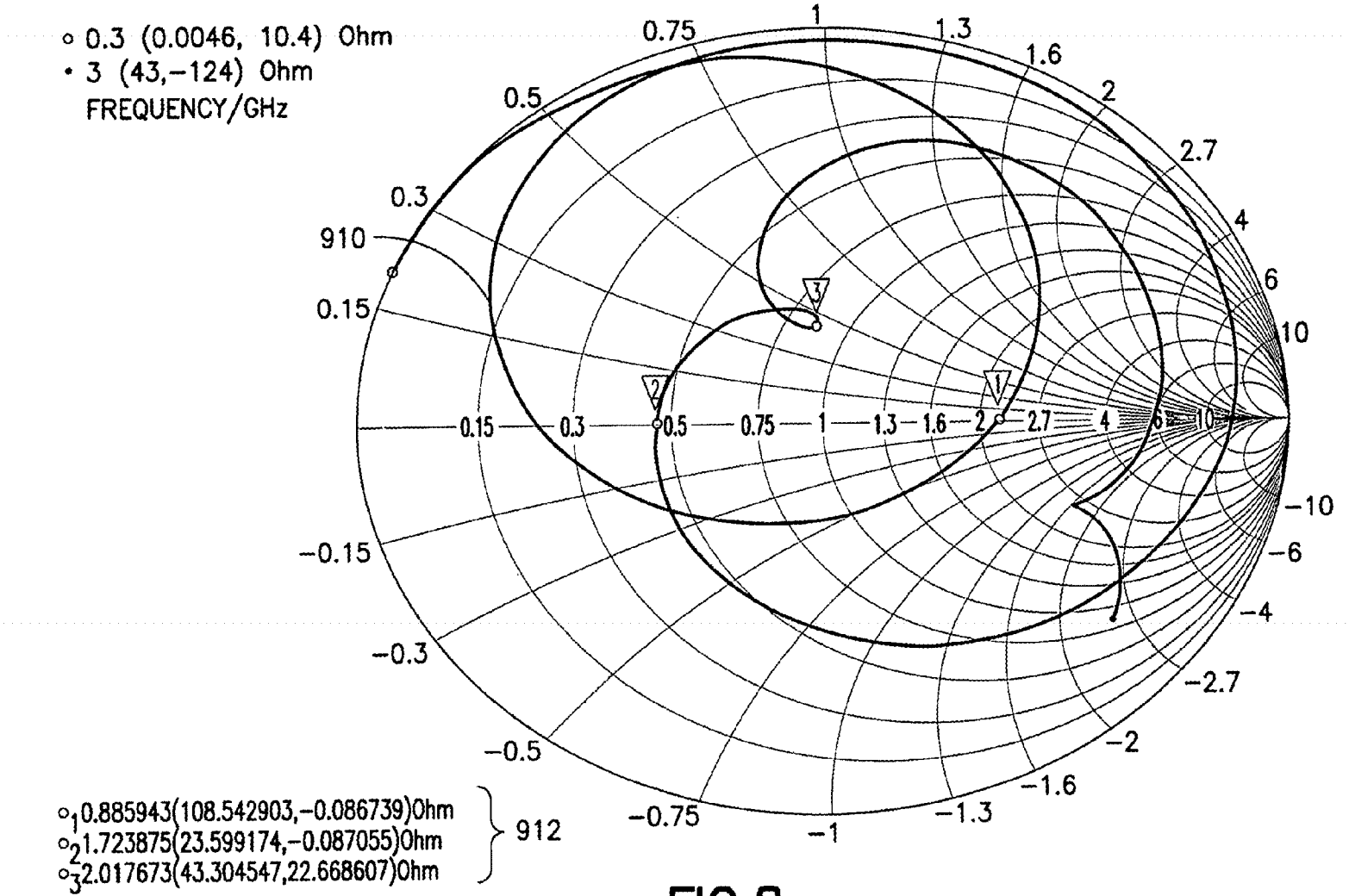
FIG. 8 is a graph of various resonant frequencies of a cellular antenna in accordance with the exemplary embodiment.

FIG. 8 is a graph of various resonant frequencies of a cellular antenna in accordance with the exemplary embodiment. The S-parameter impedance is shown by curve 910. Resonance frequencies are indicated in legend elements 912. The first three resonant frequencies of the TV antenna are as follows: f1cel at approximately 886 MHz, f2cel at approximately 1,720 MHz and f3cel at approximately 2,010 MHz.

Figure 9:
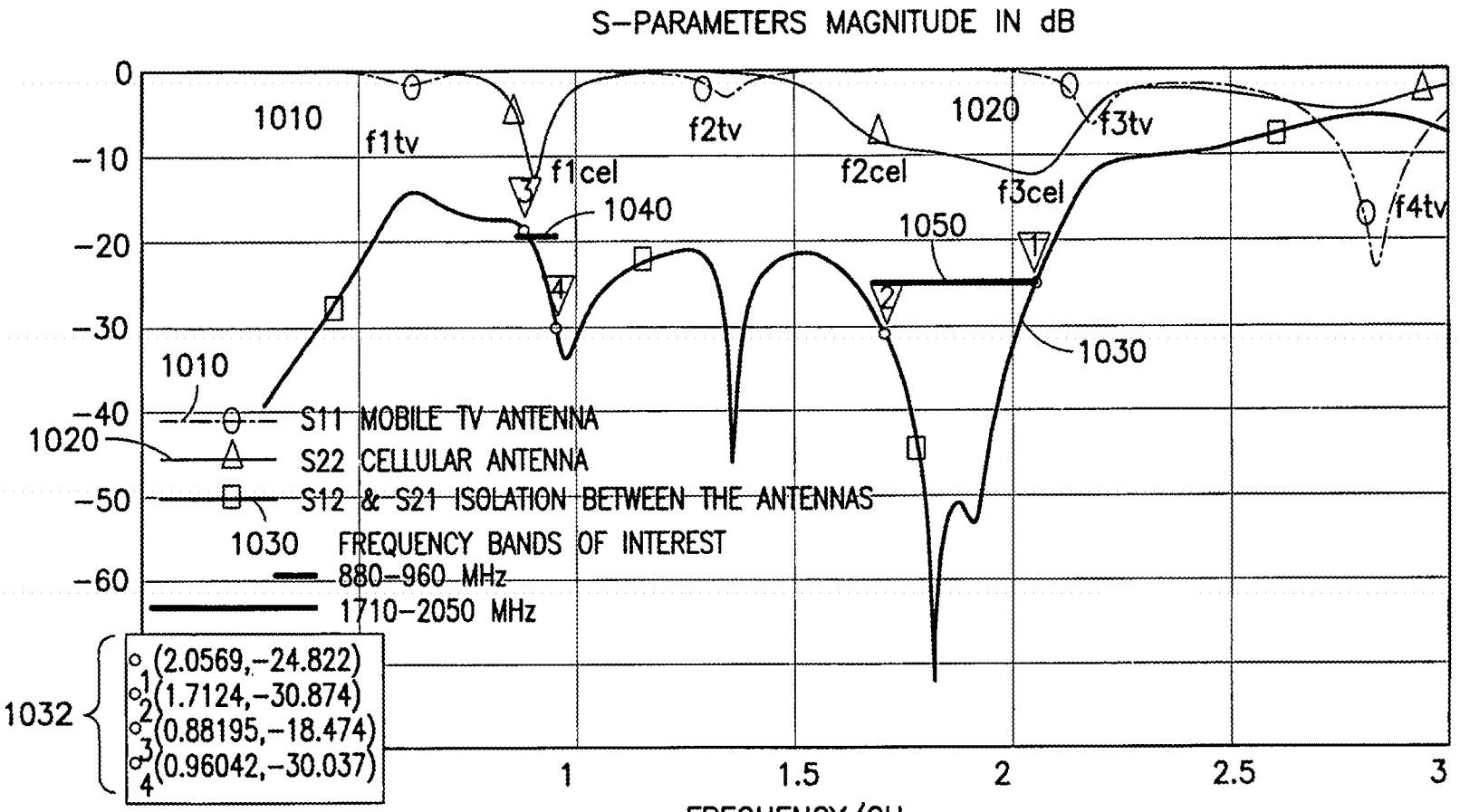
FIG. 9 demonstrates the relationship of resonant frequencies and isolation of a first antenna arrangement in accordance with the exemplary embodiment.

FIG. 9 demonstrates the relationship of resonant frequencies and isolation of an antenna arrangement in accordance with the exemplary embodiment. The S-parameter magnitude is shown as a function of frequency. The return loss (S11) response 1010 of a TV antenna and the return loss response (S22) 1020 of a cellular antenna are shown with relative minimums corresponding to the resonant frequencies of the antenna. The isolation curve (S12 & S21) 1030 between the TV antenna and the cellular antenna is also shown.

Highlights 1040, 1050 are provided to show frequency ranges of note to wireless communications. Specifically, highlight 1040 is provided to show a range of 880-960 MHz and highlight 1050 is provided to show a range of 1,710-2,050 MHz. Antenna isolation in these ranges helps ensure the TV antenna and cellular antenna can function properly. Legend elements 1032 correspond to various points in the highlighted frequency ranges.

The first resonance mode (such as f1tv, f1ceD of a monopole antenna comes from a quarter wave long radiator, $L=\lambda/4$. Other resonance modes are higher order resonances (such as f2tv, f3tv, f4tv, f2cel, f3cel, etc.), where $L=\lambda/4+n*\lambda/2$, where n is an integer. As noted above, the resonant frequencies of an antenna influence electric and magnetic field distributions of standing waves in the radiator.

An antenna's electrical length, L, is a function of its frequency. A point that is described as $\lambda/4$ away from the feed is valid for that resonant frequency. The same point may be described as being a distance from the feed, such as $\sim\lambda/8$ at f1tv, $\sim3\lambda/8$ at f2tv, $\sim5\lambda/8$ at f3tv, and $7\lambda/8$ at f4tv for example. For clarity reasons, a point (such as a point in the isolation area for example) may be referred to as being approximately L/2 from the feed.

In the cellular antenna 140, the coupling between radiator elements 222 and 212 may affect the location of electric and magnetic field distributions in radiator element 222. Likewise, the shape of the radiator element 222 (such as having multiple arms for example) may also impact the location of electric and magnetic field distributions. For clarity reasons, a point on such an antenna (such as a point on the longer arm which is in the isolation area for example) may be referred to as being approximately L/2 from the feed. This non-limiting example would coincide with a distance from the feed of $\sim\lambda/8$ at f1cel and $\sim3/\lambda8$ at f2cel.

Figure 10A:
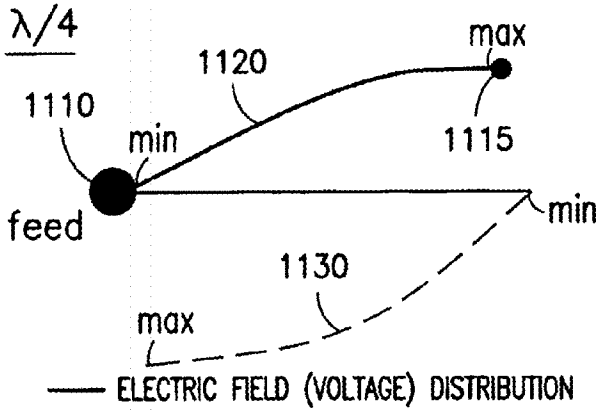
FIGS. 10A-10D, collectively referred to as FIG. 10, depict electric field and magnetic field distribution for various resonance modes of a TV antenna in accordance with the exemplary embodiment.

FIGS. 10A-10D, collectively referred to as FIG. 10, depict electric field and magnetic field distribution for various resonance modes of a TV antenna in accordance with the exemplary embodiment. FIG. 10A depicts the $\lambda/4$ resonance mode. The electric field distribution 1120 goes from a minimum at the feed 1110 to a maximum value at the open end of the radiator. The magnetic field distribution 1130 is also shown. The length of the TV antenna, from the feed point 1110 to the open end 1115, may be given as L.

Figure 10B:
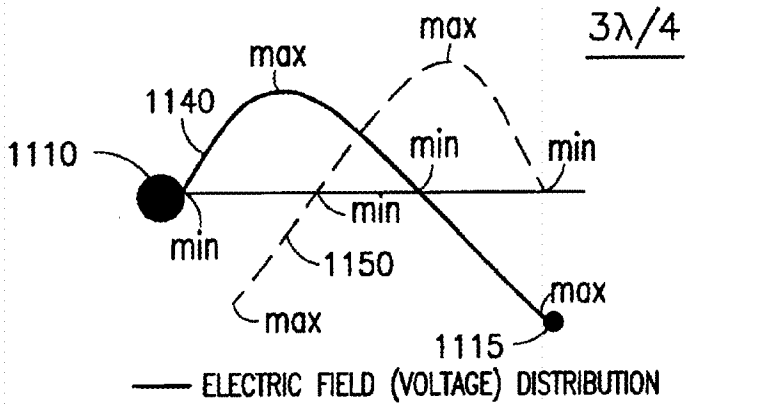
Figure 10C:
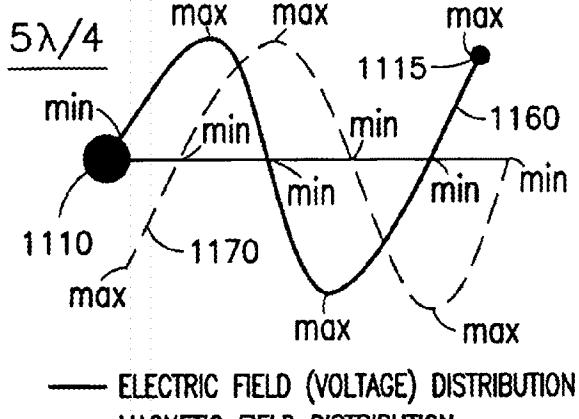
Figure 10D:
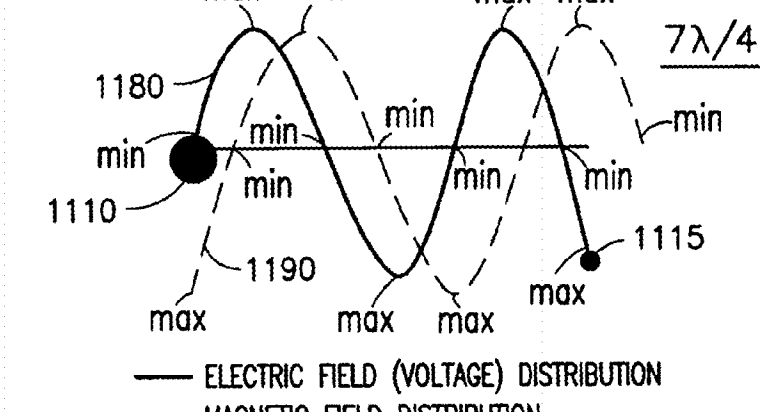

FIG. 10B depicts the $3\lambda/4$ resonance mode showing the electric field distribution 1140 and magnetic field distribution 1150. The electric field distribution 1140 also begins at a minimum at the feed 1110 and reaches two maximum values at discrete points along the length of the radiator. FIG. 10C depicts the $5\lambda/4$ resonance mode showing the electric field distribution 1160 and magnetic field distribution 1170. The electric field distribution 1160 also begins at a minimum at the feed 1110 and reaches three maximum values at discrete points along the length of the radiator. FIG. 10D depicts the $7\lambda/4$ resonance mode showing the electric field distribution 1180 and magnetic field distribution 1190. The electric field distribution 1180 also begins at a minimum at the feed 1110 and reaches four maximum values at discrete points along the length of the radiator.

Figure 11A:
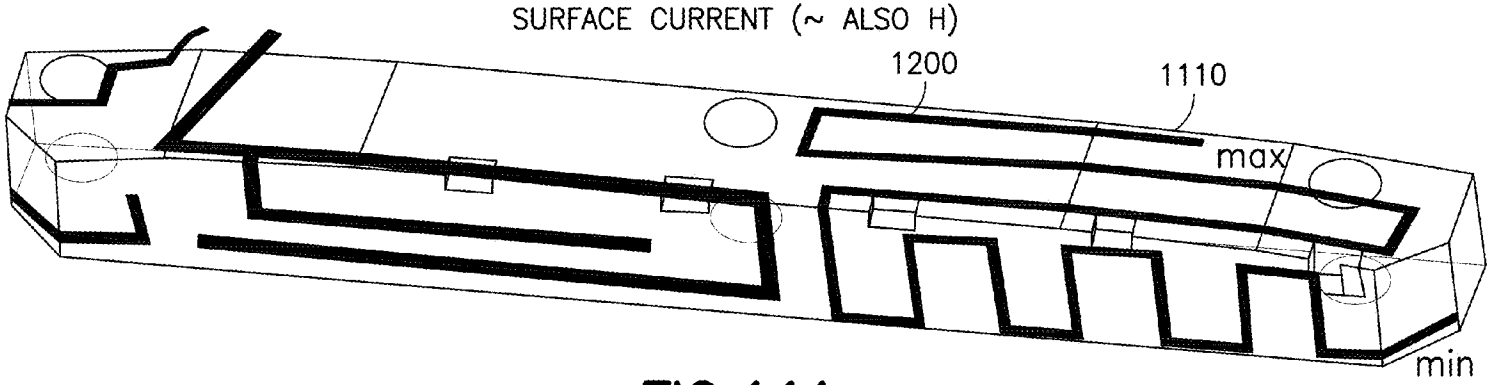
FIGS. 11A-11B, collectively referred to as FIG. 11, show electric field and surface current distribution for a $\lambda/4$ resonance mode of the TV antenna in accordance with the exemplary embodiment.
Figure 11B:
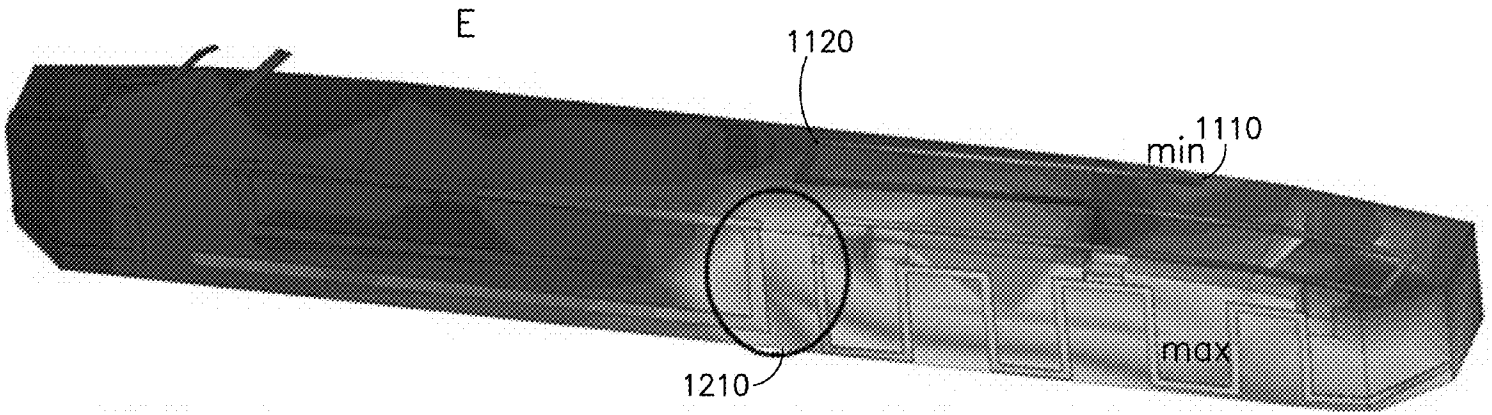

FIGS. 11A-11B, collectively referred to as FIG. 11, show electric field and surface current distribution for a $\lambda/4$ resonance mode, f1tv (approx. 605 MHz), of the TV antenna in accordance with the exemplary embodiment. FIG. 11A shows the surface current distribution 1200 corresponding to electric field distribution 1120. FIG. 11B shows the electric field corresponding to electric field distribution 1120. At area 1210 the electric field shows a coupling between the TV antenna and the cellular antenna. This is a mechanism for transferring energy between the two antennas and if there is too much energy transfer, this can cause isolation problems.

Figure 12A:
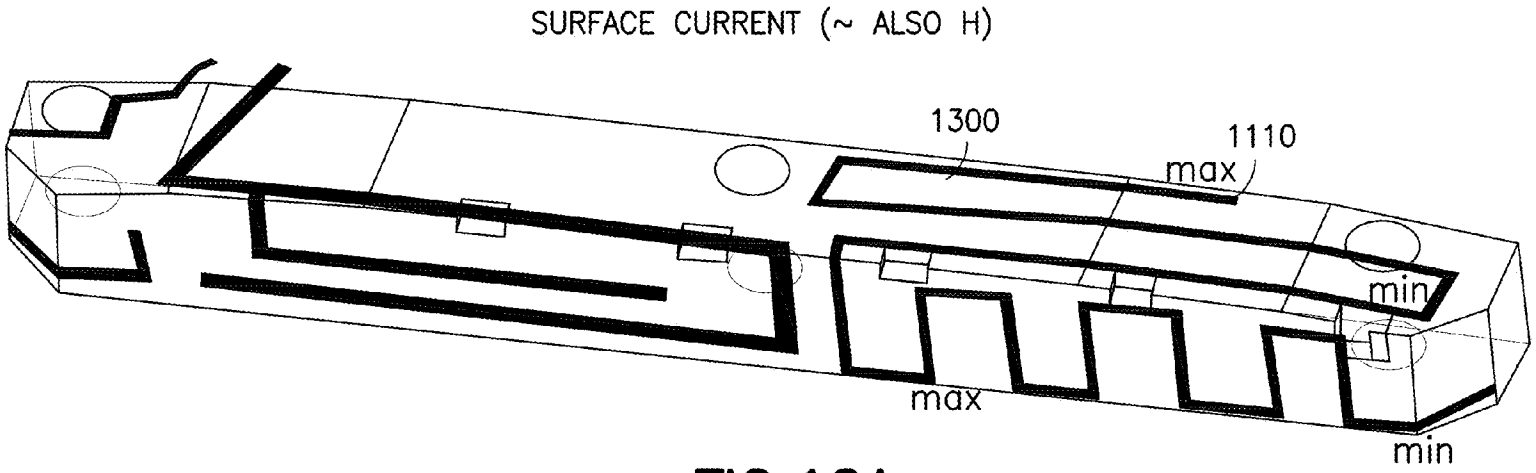
FIGS. 12A-12B, collectively referred to as FIG. 12, show electric field and surface current distribution for a $3\lambda/4$ resonance mode of the TV antenna in accordance with the exemplary embodiment.
Figure 12B:
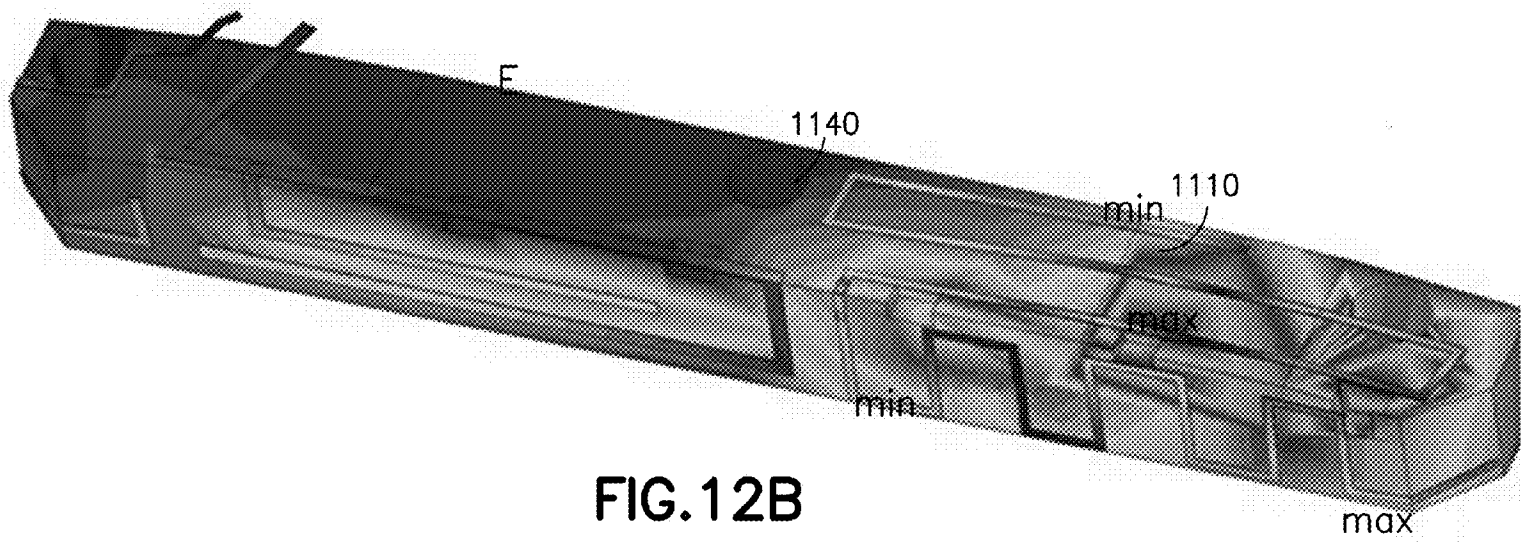

FIGS. 12A-12B, collectively referred to as FIG. 12, show electric field and surface current distribution for a $3\Delta/4$ resonance mode, f2tv (approx. 1,330 MHz), of the TV antenna in accordance with the exemplary embodiment. FIG. 12A shows the surface current distribution 1300 corresponding to electric field distribution 1140 and FIG. 12B shows the electric field corresponding to electric field distribution 1140.

Figure 13A:
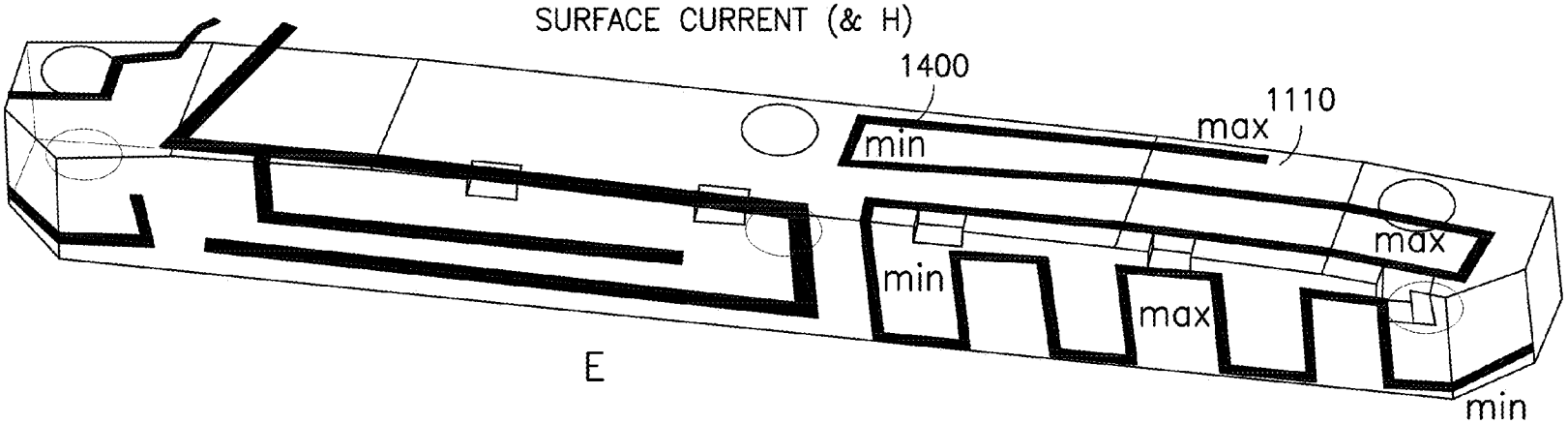
FIGS. 13A-13B, collectively referred to as FIG. 13, show electric field and surface current distribution for a $5\lambda/4$ resonance mode of the TV antenna in accordance with the exemplary embodiment.
Figure 13B:
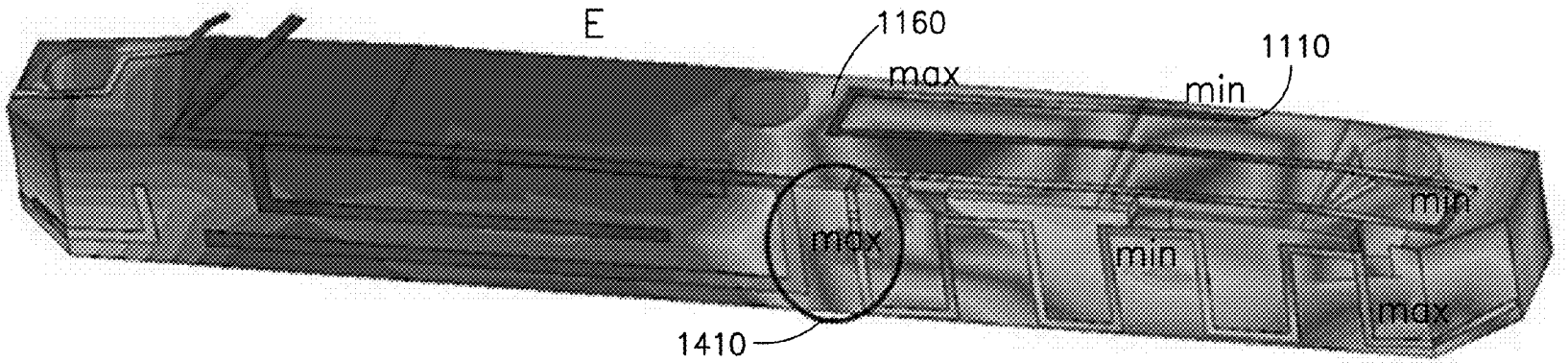

FIGS. 13A-13B, collectively referred to as FIG. 13, show electric field and surface current distribution for a $5\lambda/4$ resonance mode, f3tv (approx. 2,160 MHz), of the TV antenna in accordance with the exemplary embodiment. FIG. 13A shows the surface current distribution 1400 corresponding to electric field distribution 1160 and FIG. 13B shows the electric field corresponding to electric field distribution 1160. Similar to as seen in FIG. 11B, area 1410 indicates where the electric field couples between the TV antenna and the cellular antenna.

Figure 14A:
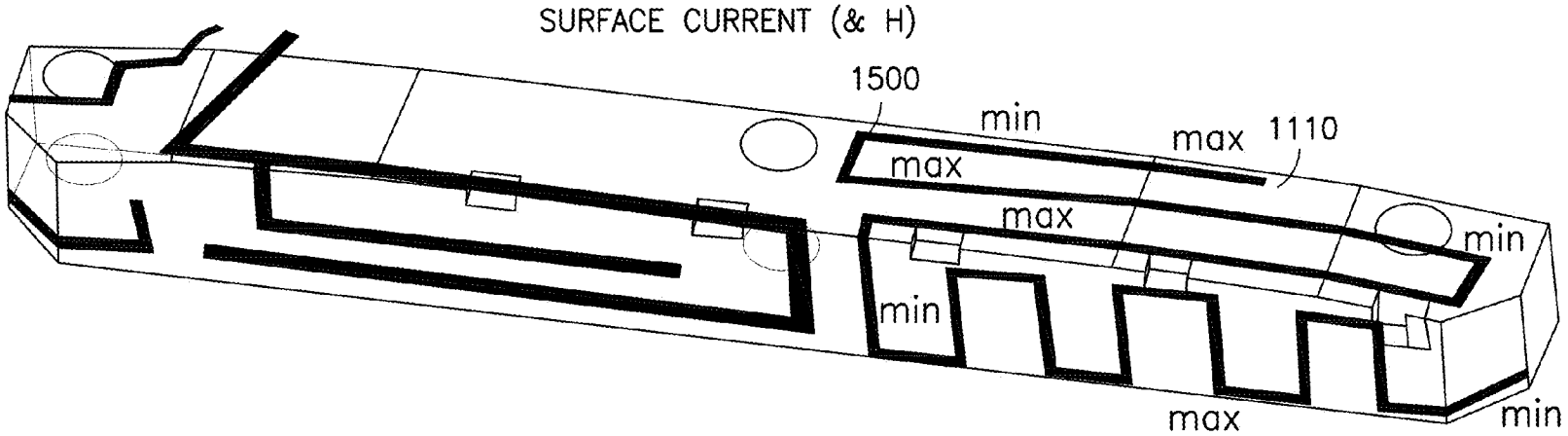
FIGS. 14A-14B, collectively referred to as FIG. 14, show electric field and surface current distribution for a $7\lambda/4$ resonance mode of the TV antenna in accordance with the exemplary embodiment.
Figure 14B:
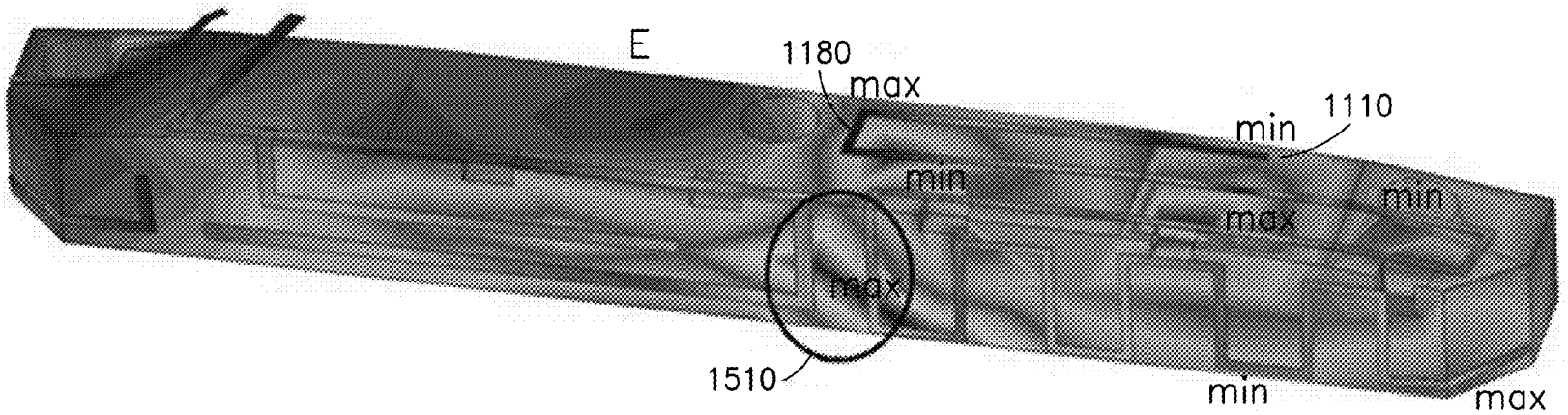

FIGS. 14A-14B, collectively referred to as FIG. 14, show electric field and surface current distribution for a $7\lambda/4$ resonance mode, f4tv (approx. 2,830 MHz), of the TV antenna in accordance with the exemplary embodiment. FIG. 14A shows the surface current distribution 1500 corresponding to electric field distribution 1180 and FIG. 14B shows the electric field corresponding to electric field distribution 1180. Similar to as seen in FIGS. 11B and 13B, the electric field couples between the TV antenna and the cellular antenna in area 1510.

Figure 15A:
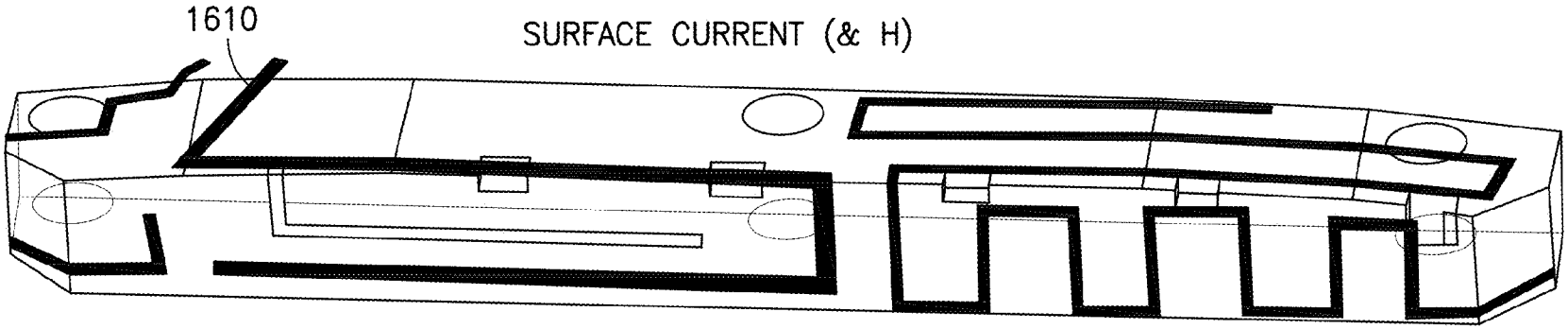
FIGS. 15A-15B, collectively referred to as FIG. 15, show electric field and surface current distribution for a f1cel resonance mode of a cellular antenna in accordance with the exemplary embodiment.
Figure 15B:
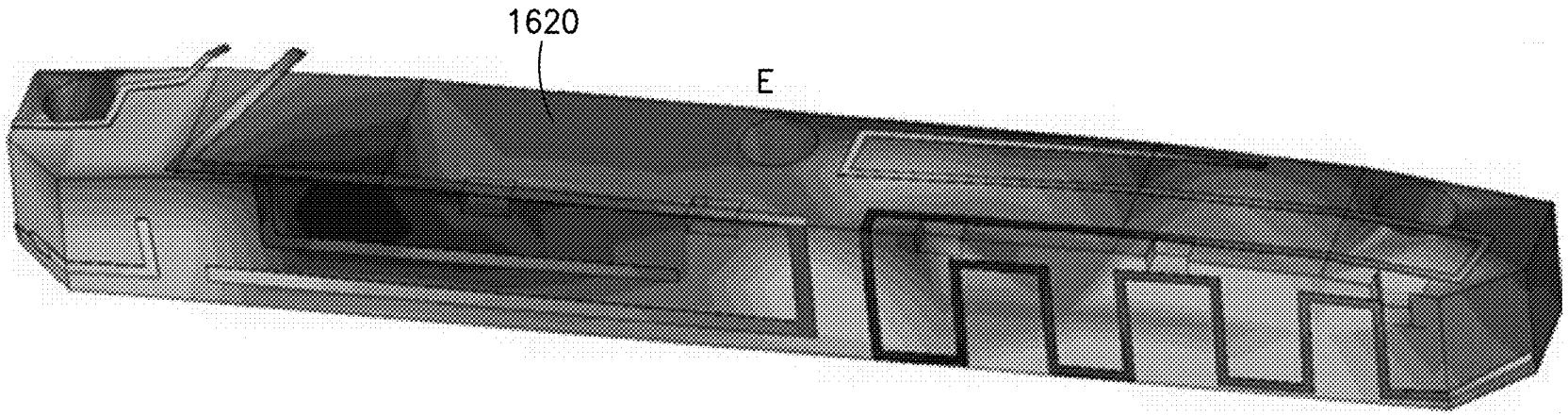

FIGS. 15A-15B, collectively referred to as FIG. 15, show electric field and surface current distribution for a first resonance mode, f1cel (approx. 900 MHz), of a cellular antenna in accordance with the exemplary embodiment. FIG. 15A shows the surface current distribution 1610 and FIG. 15B shows the electric field 1620.

Figure 16A:
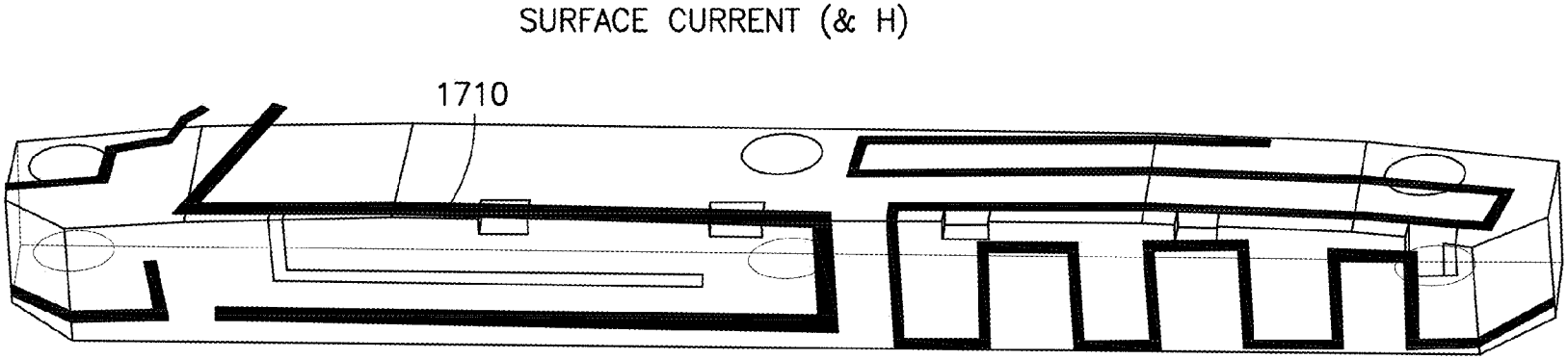
FIGS. 16A-16B, collectively referred to as FIG. 16, show electric field and surface current distribution for a f2cel resonance mode of the cellular antenna in accordance with the exemplary embodiment.
Figure 16B:
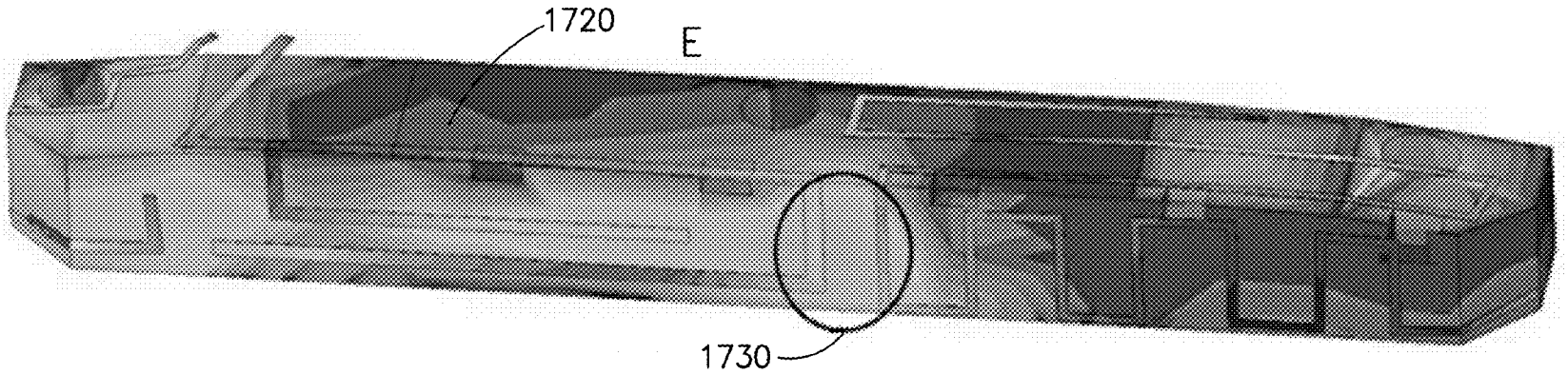

FIGS. 16A-16B, collectively referred to as FIG. 16, show electric field and surface current distribution for a second resonance mode, f2cel (approx. 1,720 MHz), of the cellular antenna in accordance with the exemplary embodiment. FIG. 16A shows the surface current distribution 1710 and FIG. 16B shows the electric field 1720. Similar to as seen in FIGS. 11B, 13B and 14B, the electric field 1820 couples between the TV antenna and the cellular antenna in area 1730.

Figure 17A:
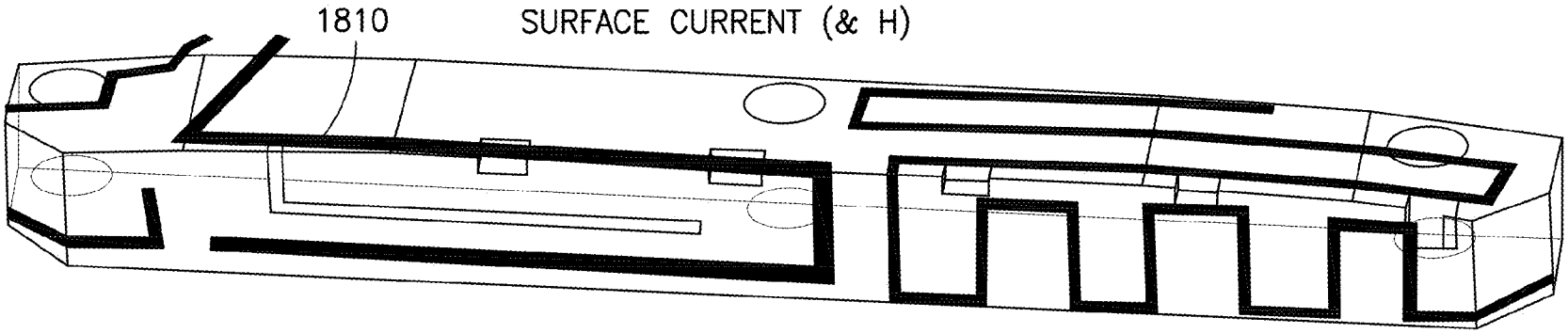
FIGS. 17A-17B, collectively referred to as FIG. 17, show electric field and surface current distribution for a f3cel resonance mode of the cellular antenna in accordance with the exemplary embodiment.
Figure 17B:
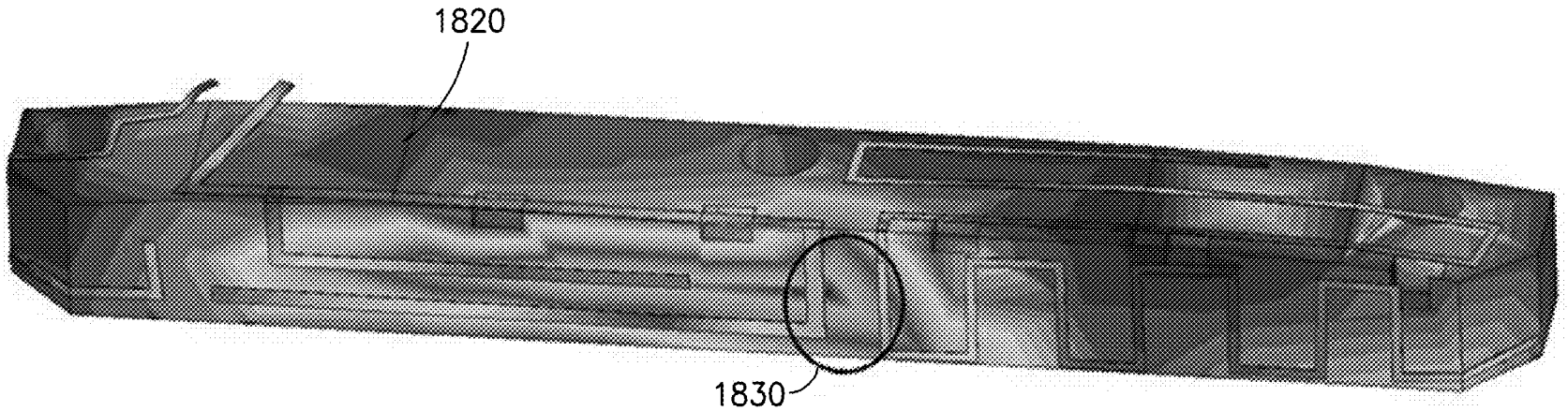

FIGS. 17A-17B, collectively referred to as FIG. 17, show electric field and surface current distribution for a third resonance mode, f3cel (approx. 2,010 MHz), of the cellular antenna in accordance with the exemplary embodiment. FIG. 17A shows the surface current distribution 1810 and FIG. 17B shows the electric field 1820. Similar to as seen in FIGS. 11B, 13B, 14B and 16B, the electric field 1820 couples between the TV antenna and the cellular antenna in area 1830.

Figure 18A:
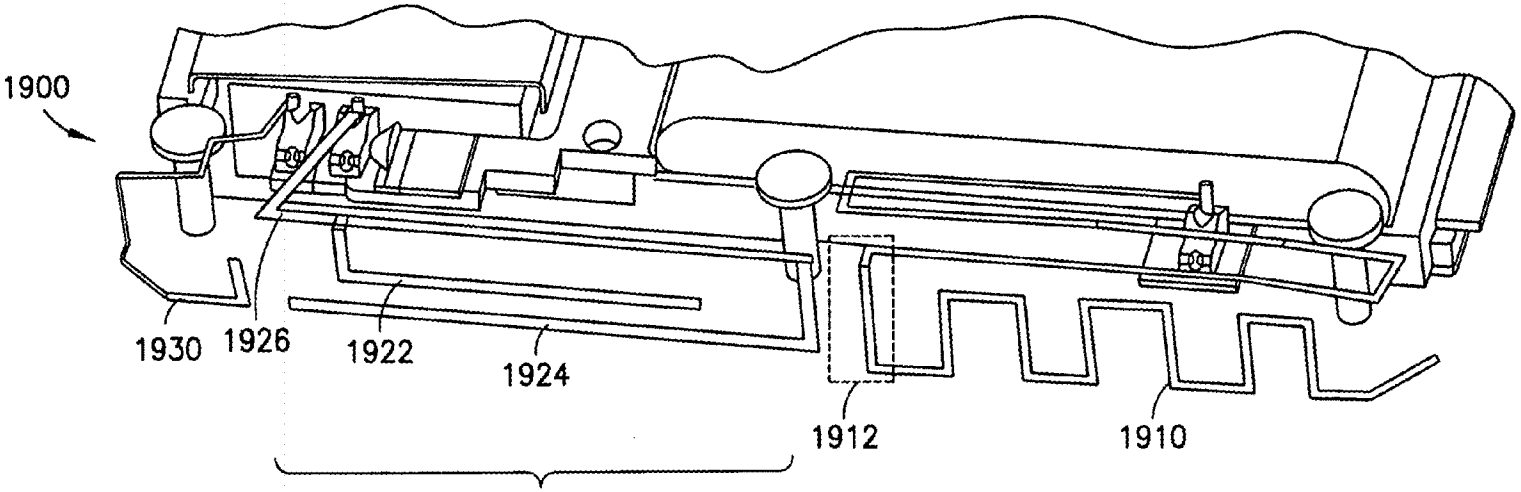
FIGS. 18A-18B, collectively referred to as FIG. 18, illustrate a first embodiment (or "Original") TV antenna design (FIG. 18A) and a second embodiment (or "Modified") TV antenna design (FIG. 18B), both of which are in accordance with various exemplary embodiment.
Figure 18B:
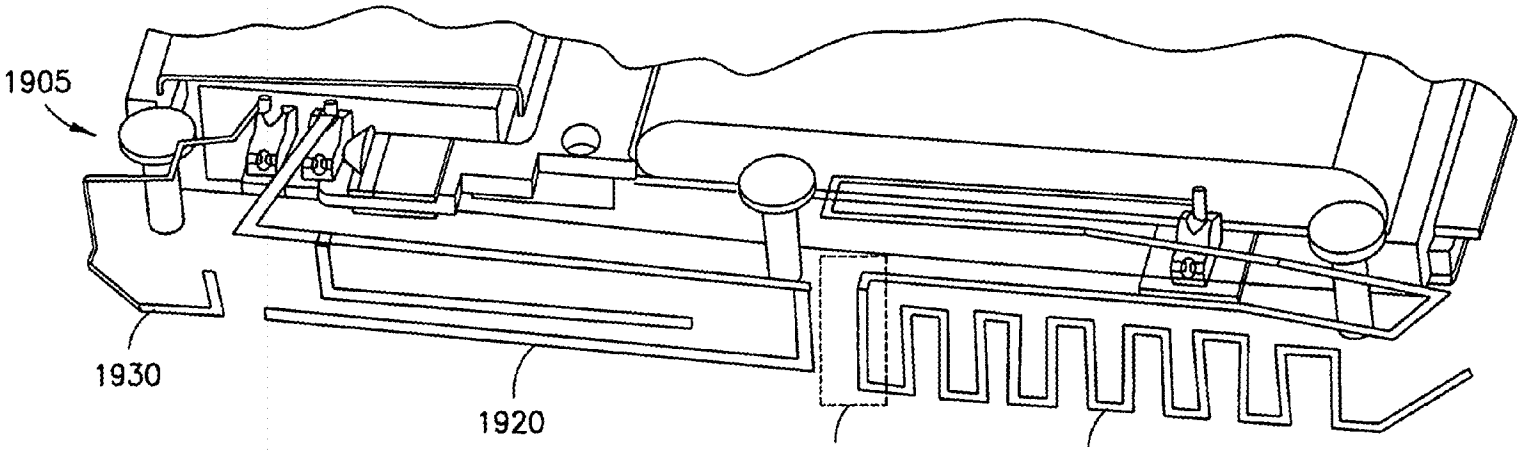

FIGS. 18A-18B, collectively referred to as FIG. 18, illustrate a first embodiment (or "Original") TV antenna design (FIG. 18A) and a second embodiment (or "Modified") TV antenna design (FIG. 18B), both of which are in accordance with various exemplary embodiments. In FIG. 18A, the antenna arrangement 1900 includes a cellular antenna having a single feed monopole resonant element 1920 and a parasitic resonant element 1930. Antenna arrangement 1900 also includes a resonant element 1910 of a TV antenna. A first portion 1912 of the resonant element 1910 is in close proximity to the single feed monopole resonant element 1910. The monopole resonant element 1920 comprises two distinct conductive portions 1922, 1924 which share the common feed 1926 and where the first portion 1924 is longer than the second portion 1922 such that at least two operational frequency band resonances are generated by the monopole resonant element 1920. The first portion 1912 of the resonant element 1910 is in close proximity to the first portion 1924 of the monopole resonant element 1920, and more specifically approximately half way along the length of the first portion 1924. Resonant element 1910 is designed so that specific resonant frequencies do not have standing waves causing electric field maxima in portion 1912.

FIG. 18B shows the "Modified" antenna arrangement 1905 which is similar to antenna arrangement 1900 of FIG. 18A, both having a single feed monopole resonant element 1920 and a parasitic resonant element 1930. While standing waves causing electric field maxima in portion 1916 are prevented by the design of a resonant element 1915, resonant element 1920 is modified over the design of resonant element 1915 to lessen this restriction in order to allow less coupling between resonant element 1915 and resonant element 1920. As seen below, this coupling results in a decrease in isolation.

Figure 19:
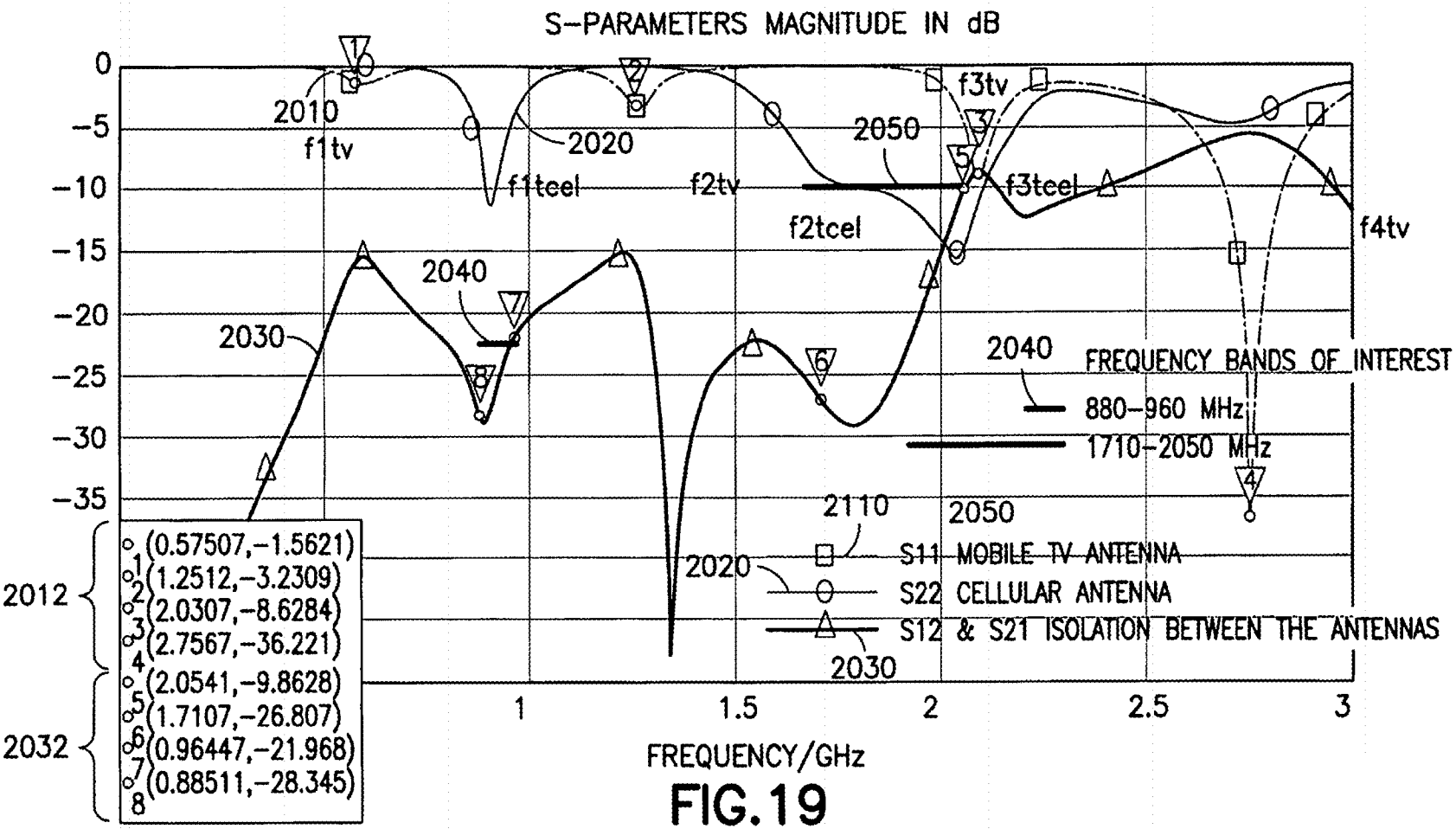
FIG. 19 depicts a relationship of resonant frequencies and isolation using a "Modified" TV antenna design.

FIG. 19 demonstrates the relationship of resonant frequencies and isolation of a "Modified" antenna arrangement 1905 as shown in FIG. 18B. The response 2010 of a TV antenna and the response 2020 of a cellular antenna are shown with relative minimums corresponding to the resonant frequencies of the respective antenna. Legend elements 2012 correspond to various points on the cellular antenna response 2010.

The isolation curve 2030 between the TV antenna and the cellular antenna is also shown. Highlight 2040 is provided to show a range of 880-960 MHz and highlight 2050 is provided to show a range of 1,710-2,050 MHz. Antenna isolation in these ranges helps ensure the TV antenna and cellular antenna can function properly. Legend elements 2032 correspond to various points on the isolation curve 2030.

Figure 20:
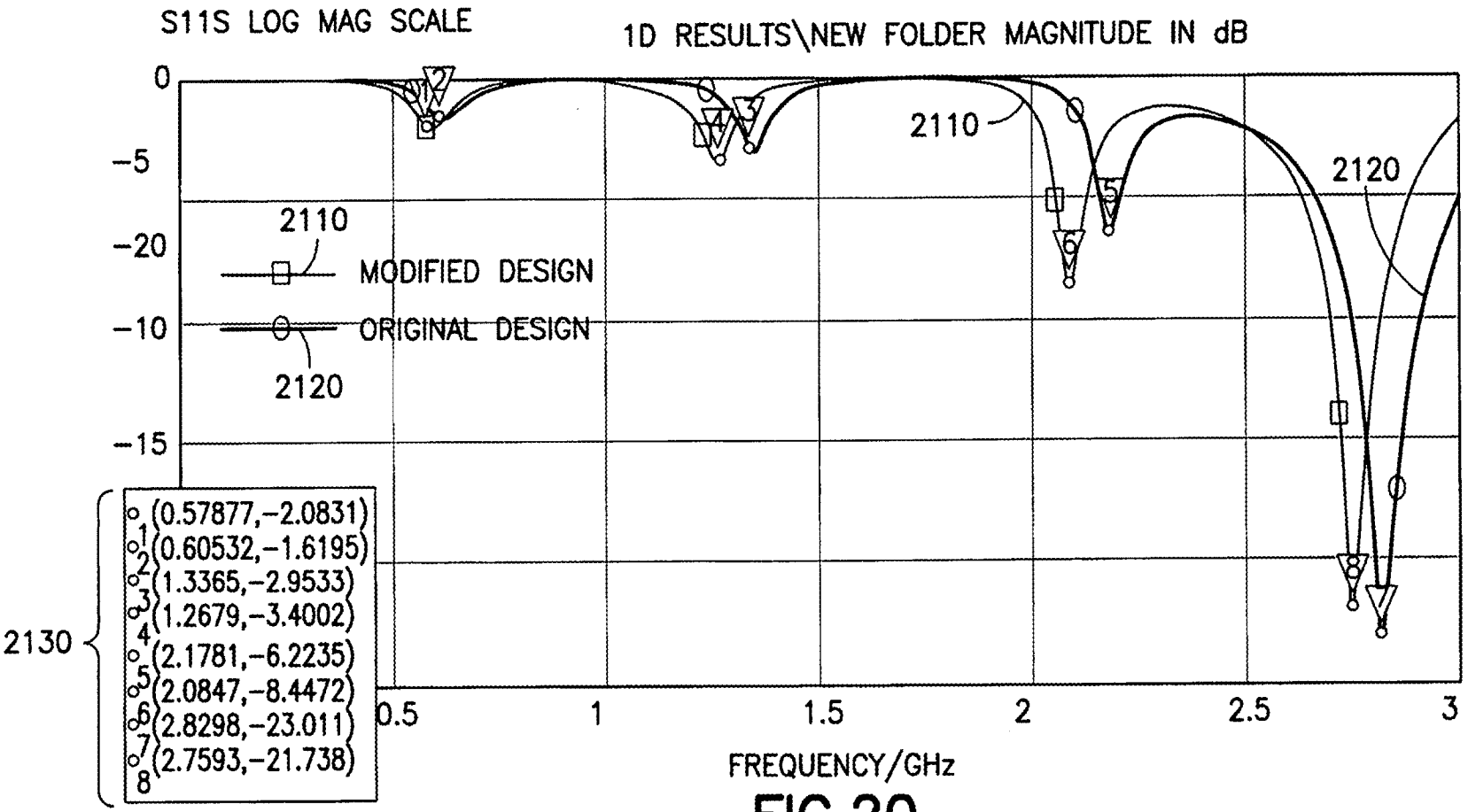
FIG. 20 shows resonant frequencies for the "Original" TV antenna design and the "Modified" TV antenna design.

FIG. 20 shows resonant frequencies for the "Original" TV antenna design and the "Modified" TV antenna design. Legend elements 2130 correspond to various points on the "Original" TV antenna response 2120 and on the "Modified" TV antenna response 2110. As shown, both response curves 2110, 2120 have similar resonant frequencies.

Figure 21:
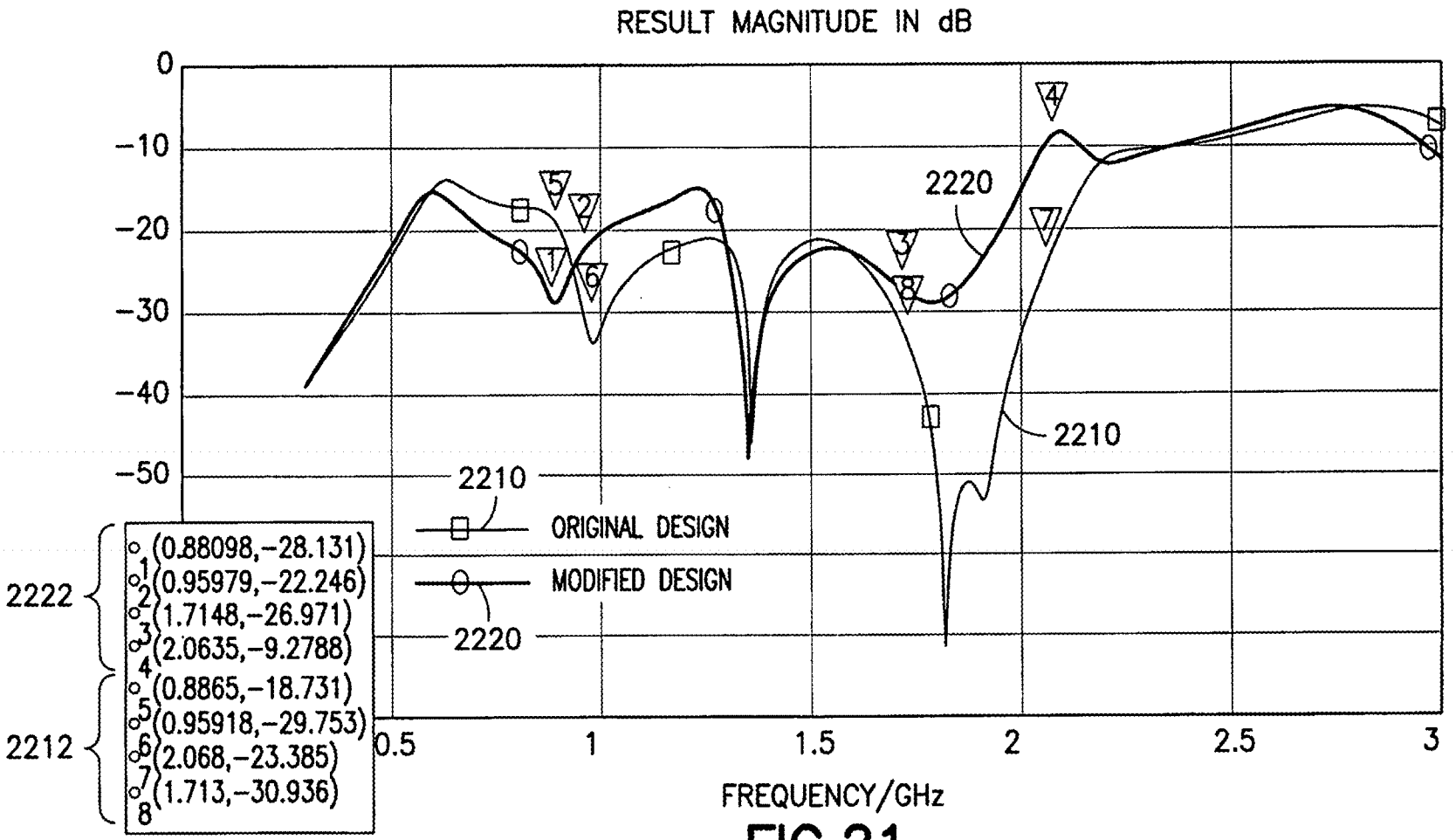
FIG. 21 shows the isolation for the "Original" TV antenna design and the "Modified" TV antenna design.

FIG. 21 shows the isolation for the "Original" TV antenna design and the "Modified" TV antenna design. While, as shown in FIG. 20, both TV antenna designs have similar resonant, frequencies, the isolation between the TV antenna designs and the single feed monopole resonant element 1920 is not the same. The isolation curve 2210 (similar to isolation curve 1030 shown in FIG. 9) shows the isolation of the "Original" TV antenna design while isolation curve 2220 (similar to isolation curve 2030 shown in FIG. 19) shows the isolation of the "Modified" TV antenna design. Legend elements 2212 correspond to various points on the isolation curve 2210 and legend elements 2222 correspond to various points on the isolation curve 2220.

Weak isolation occurs when the resonance (such as f3tv) of a first antenna, radiator or resonant element, for example the TV antenna, overlaps or is too close in frequency to a second antenna, radiator or resonant element, for example the cellular antenna, operating at least in a high band, for example 1700-2100 MHz. At the resonant frequency, the TV antenna radiator generates a standing wave that causes electric field maxima at the area next to the cellular antenna. This causes strong electric field coupling between the antennas and leads to poor isolation. In the "Original" antenna arrangement, the f3tv resonant frequency is more apart from 2,050 MHz (f3cel) than in the "Modified" antenna arrangement. Thus, the standing wave is weaker or not similarly excited and the electric field coupling is weaker causing better isolation.

Figure 22A:
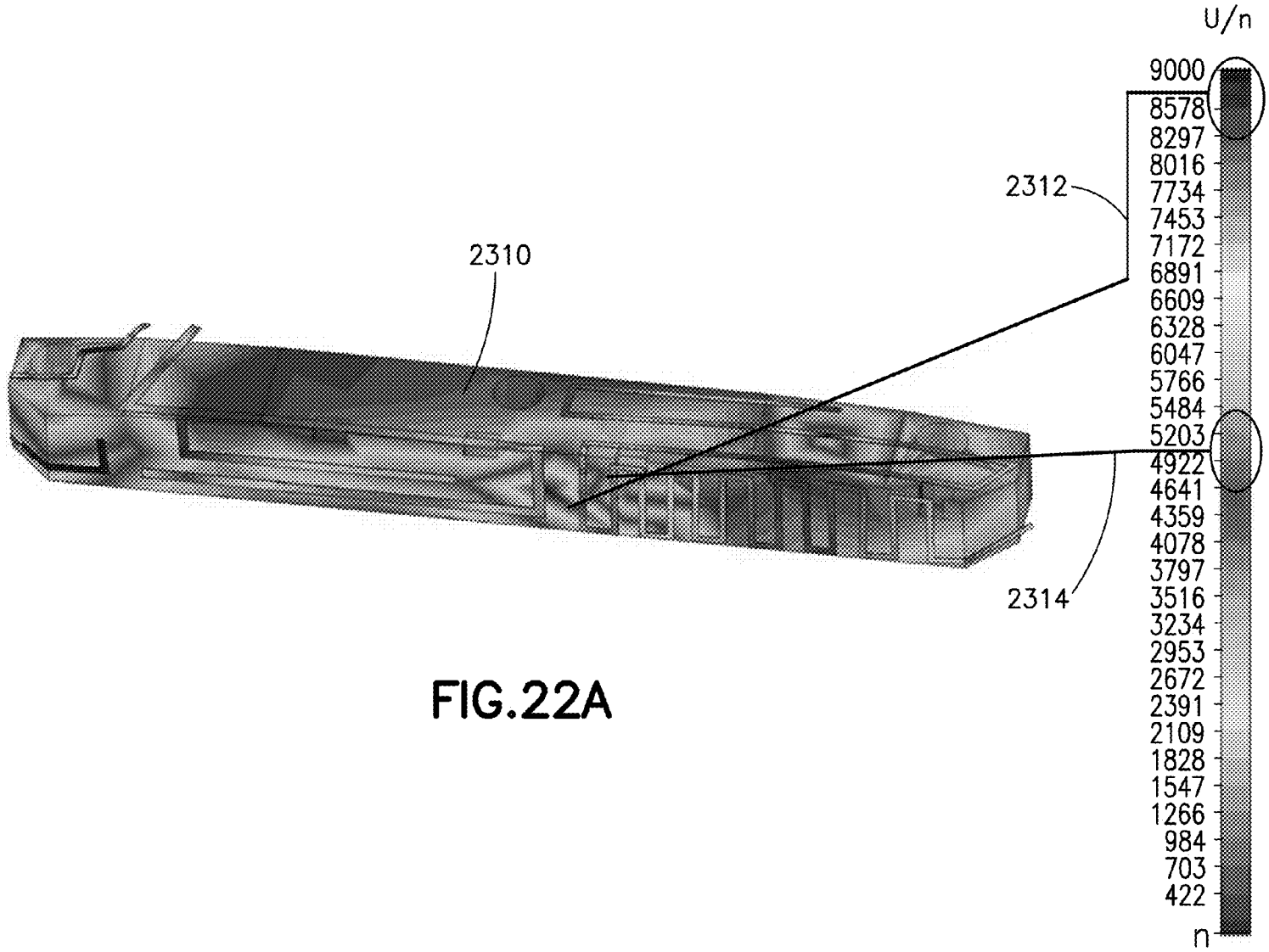
FIGS. 22A-22B, collectively referred to as FIG. 22, show electric field distribution for a f3tv resonance mode of the "Modified" TV antenna design (FIG. 22A) and of the "Original" TV antenna design (FIG. 22B).
Figure 22B:
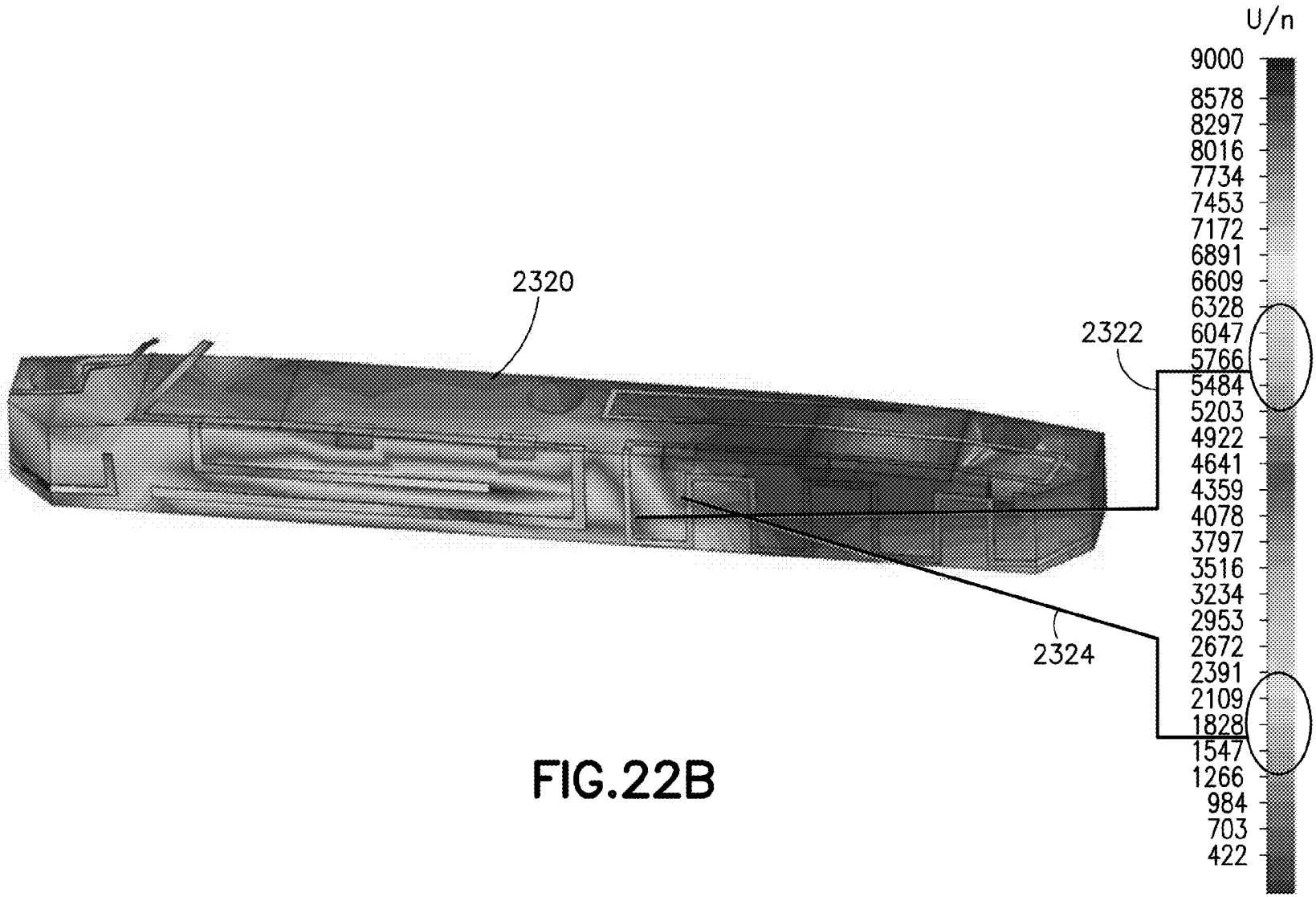

FIGS. 22A-22B, collectively referred to as FIG. 22, show electric field distribution for a f3tv resonance mode of the "Modified" TV antenna design (FIG. 22A) and of the "Original" TV antenna design (FIG. 22B). FIG. 22A shows the electric field 2310 for a frequency of 2,050 MHz (which is between f3cel, 2,010 MHz, and f3tv, 2,085 MHz). There is a standing wave which causes an electric field maxima 2312. The maxima 2312, which is considerably higher than at point 2314, is close to the cellular resonator and causes a strong electric field coupling which produces poor isolation (approx. −9.5 dB).

FIG. 22B shows the electric field 2320 for the same frequency of 2,050 MHz as in FIG. 22A. In contrast to maxima 2312, electric field 2320 has a much lower value at point 2322 (similar in strength to point 2314 of FIG. 22A). Likewise, point 2324 has a lower value than at point 2314. Thus, the standing wave is weaker (or less excited) and the coupling is weaker. The resulting isolation (approximately −23.5 dB) is better than seen in the "Modified" TV antenna design.

Figure 23A:
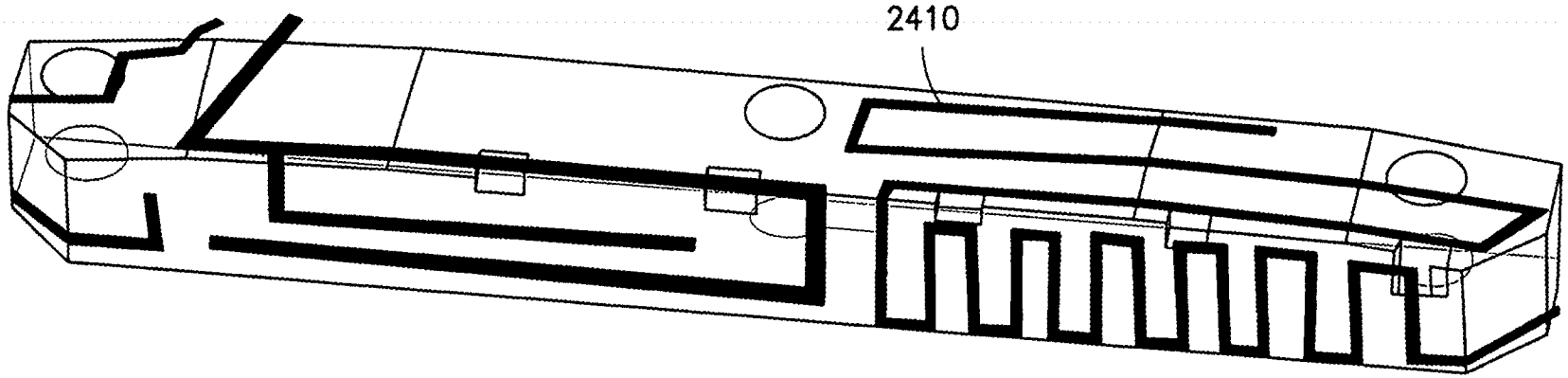
FIGS. 23A-23B, collectively referred to as FIG. 23, show surface current distribution for a frequency of 2,050 MHz of the "Modified" TV antenna design (FIG. 23A) and of the "Original" TV antenna design (FIG. 23B).
Figure 23B:
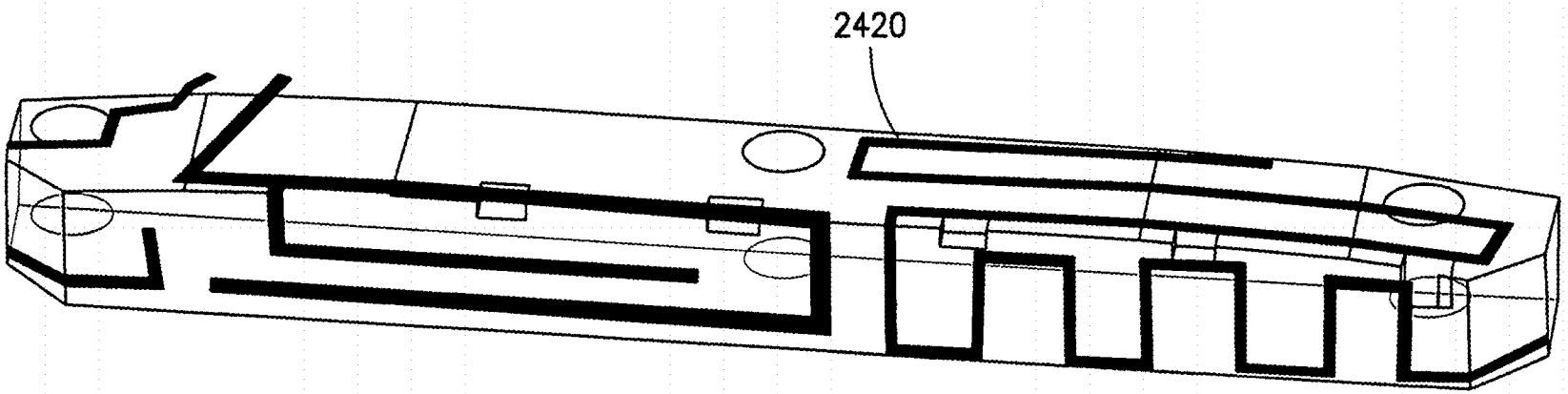

FIGS. 23A-23B, collectively referred to as FIG. 23, show surface current distribution for a resonance of 2,050 MHz of the "Modified" TV antenna design (FIG. 23A) and of the "Original" TV antenna design (FIG. 23B). The surface current distribution 2410 of FIG. 23A and the surface current distribution 2420 of FIG. 23B indicate no signs of magnetic coupling for either antenna design.

Figure 24:
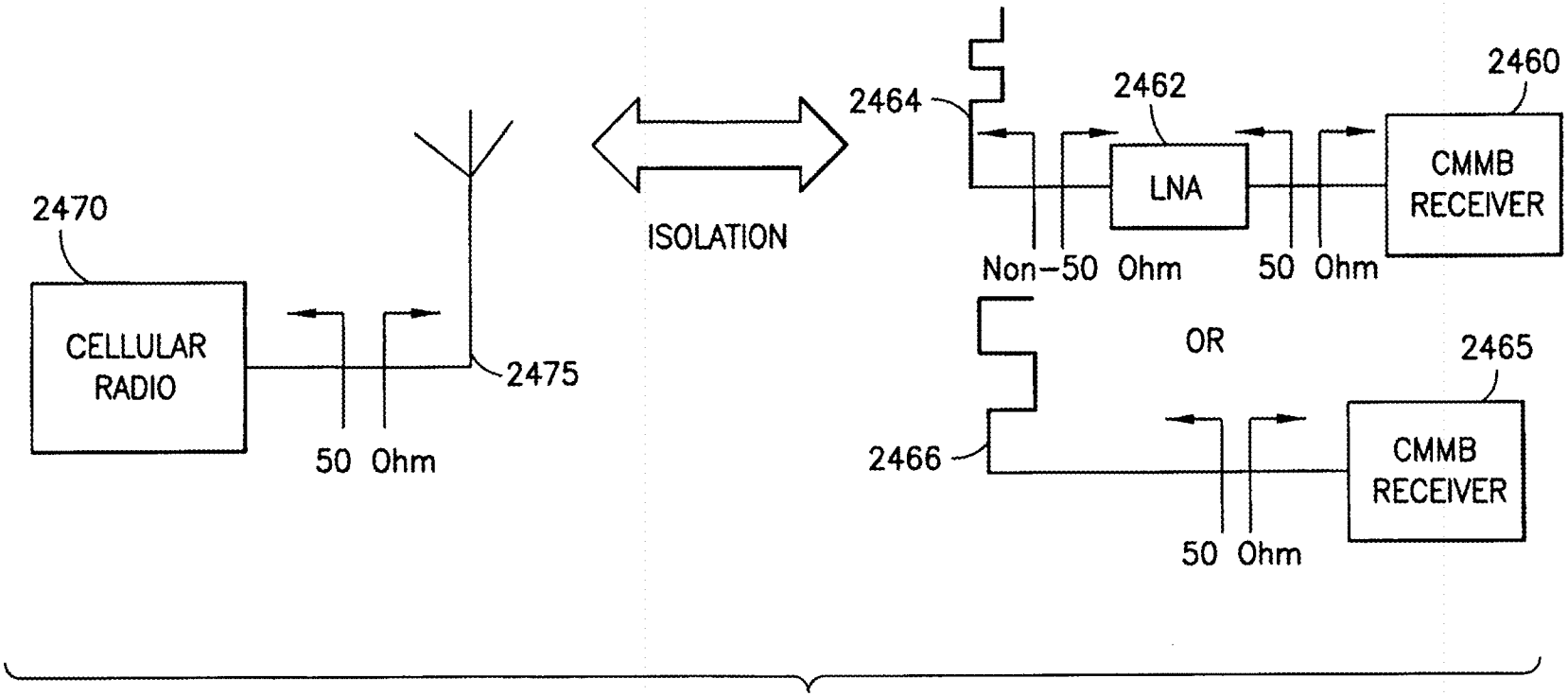
FIG. 24 demonstrates an isolation area between two antennas.

FIG. 24 demonstrates an isolation area between two antennas. A cellular radio 2470 is shown with cellular antenna 2475 having a 50 ohm radiator. The cellular radio 2470 has a level of isolation from the TV antennas 2464, 2466. TV antennas 2464, 2466 are separately coupled to CMMB receivers 2460 and 2465. TV antenna 2464 includes a non-50 ohm radiator and is coupled to the CMMB receiver 2460 via a low noise amplifier (LNA) 2462. The TV antenna 2466 may also be coupled to the CMMB receiver 2465 via an additional LNA (not shown). The TV antenna 2466 includes a 50 ohm radiator, such as a wide band matched antenna or active/tunable antenna which has a narrow band resonance that is tuned over the television frequency band with an active RF component. The wideband matched antenna or active/tunable antenna may also include a LNA (not shown) and/or the TV antenna 2466 may include a LNA (not shown).

Figure 25:
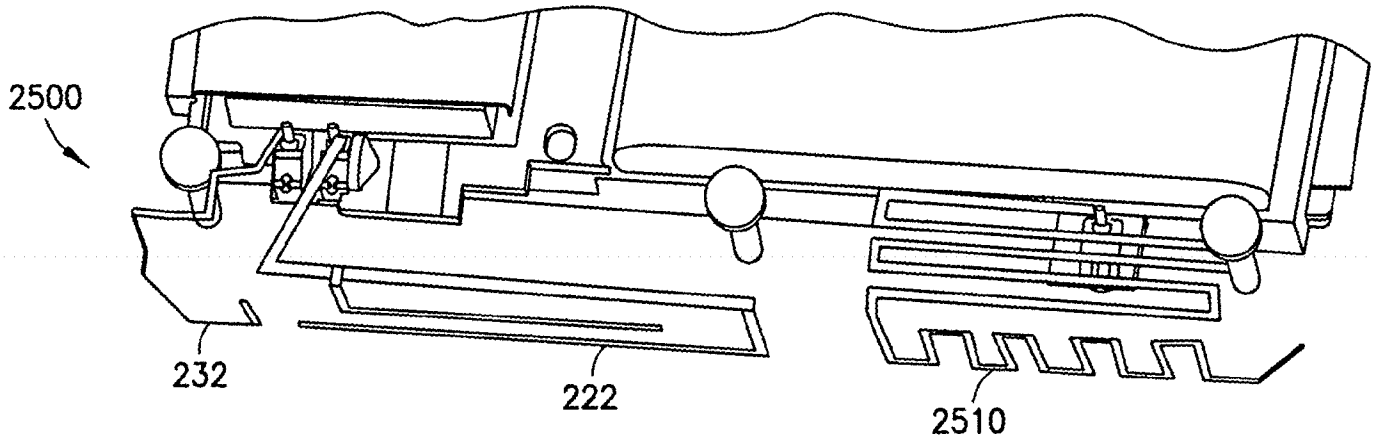
FIG. 25 depicts a further exemplary embodiment having a longer radiator.

FIG. 25 depicts a further exemplary embodiment having a longer radiator. The antenna arrangement 2500 includes radiator elements 222, 232 of a cellular antenna. The radiator element 2510 of a TV antenna is longer than the radiator element 212 of FIG. 2. This is done by including additional meandering sections. By adjusting the length, the maxima of critical resonant frequencies can be located at specific points along the radiator element 2510.

The 50 ohm isolation for antenna arrangement 2500 is approximately −11 dB at 910 MHz, −12 dB at 750 MHz and −10 dB at 1,600 MHz. The 1,600 MHz isolation is influenced by the harmonic resonance of the CMMB antenna.

Figure 26:
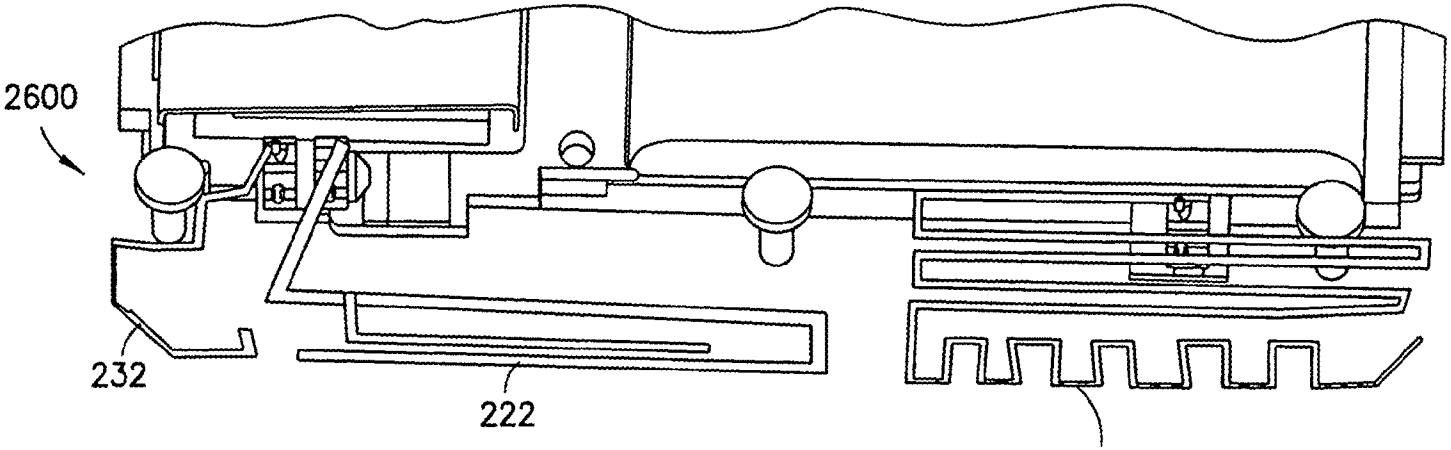
FIG. 26 depicts another exemplary embodiment having a longer radiator and a narrower strip.

FIG. 26 depicts another exemplary embodiment having a longer radiator which has a narrower conductive strip. The antenna arrangement 2600 also includes radiator elements 222, 232 of a cellular antenna. Similar to radiator element 2510 of FIG. 25, the radiator element 2610 of a TV antenna includes additional meandering sections. Radiator element 2610 also extends further in the direction opposite from radiator element 222.

The 50 ohm isolation for antenna arrangement 2600 is approximately −31 dB at 880 MHz and −11 dB at 540 MHz.

Figure 27:
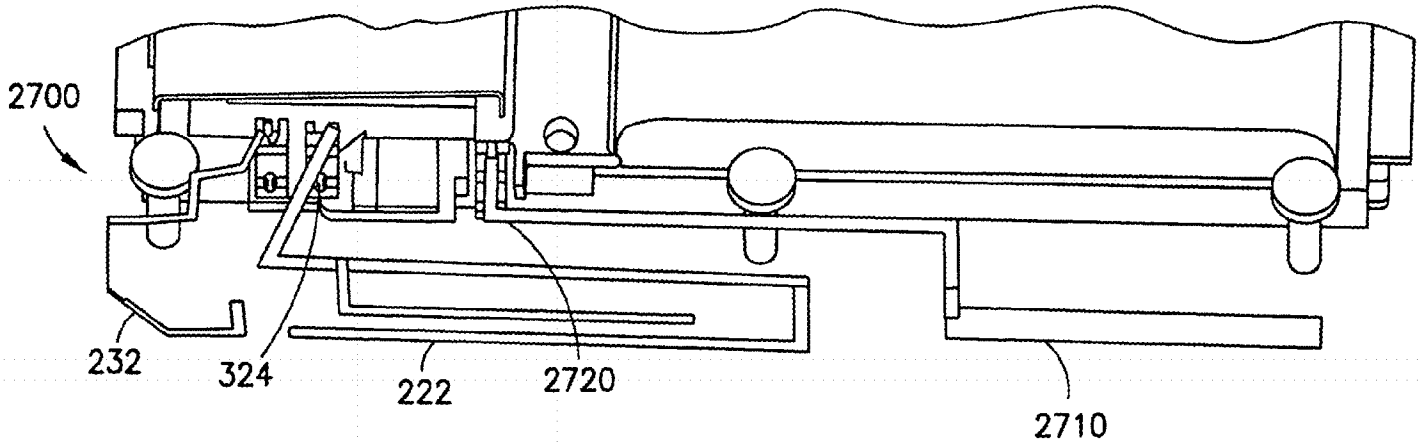
FIG. 27 depicts a further exemplary embodiment having a TV antenna and cellular antenna combination.

FIG. 27 depicts a further exemplary embodiment having a TV antenna and cellular antenna combination. The antenna arrangement 2700 includes radiator elements 222, 232 of a cellular antenna. The radiator element 2710 of a TV antenna uses a feed 2720 which is located next to a feed 324 for the radiator element 232. This design places a larger portion of the radiator element 2710 in close proximity to the radiator element 222 and risks isolation difficulties at higher frequencies. For example, the 50 ohm isolation for antenna arrangement 2600 is approximately −7.5 dB at 890 MHz and −9 dB at 1,710 MHz.

Figure 28:
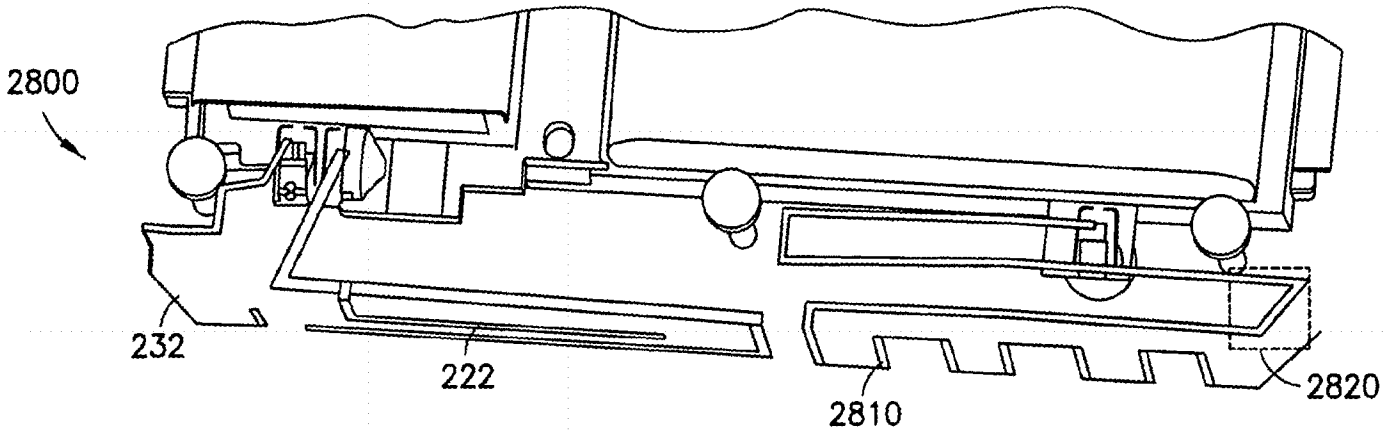
FIG. 28 depicts another exemplary embodiment having a radiator with non-right angles.

FIG. 28 depicts another exemplary embodiment having a radiator with non-right angles. The antenna arrangement 2800 includes radiator elements 222, 232 of a cellular antenna. The radiator 2810 of a TV antenna is similar to the radiator element 212 of FIG. 2. In contrast, the meandering section turns in area 2820 are made using non-right angles. This provides additional parameters which can influence the total length and the position of various frequency mode maxima in relation to the radiator element 222.

The various exemplary embodiments shown have described the adjustment of the TV antenna in order to enhance the isolation between the TV antenna (a first antenna) and a cellular antenna (a second antenna). However, it should be appreciated that various techniques can be applied in order to adjust the cellular antenna. As a non-limiting example, either or both of the TV antenna and cellular antenna may be configured so as to reduce the coupling between the antennas. Additionally, any two or more antennas (either configured for TV, RFID, cellular or any other wireless communication technology) may be used within an antenna arrangement in accordance with this invention.

Various exemplary embodiments provide an arrangement to improve isolation between closely separated antennas. The radiator arrangement is used to manipulate electric and magnetic field distributions in order to ensure that good isolation can be achieved. In one non-limiting exemplary embodiment, the arrangement includes two multi-band antennas where each antenna resonates in more than one band. Each antenna has at least one portion that is separated from the other antenna by a short distance (such as 2-15 min, for example). The closely spaced portion(s) of at least one antenna include at least one minimum electric field region of each resonant frequency such that electromagnetic coupling between the two antenna portions is minimized.

Various exemplary embodiments provide improved isolation between closely separated antennas with minimum space, complexity and cost. The isolation is ensured by an appropriate arrangement of the antenna radiators. Modern mobile devices may have many antennas which will be closely spaced and if they are not designed properly, the antennas will be negatively impacted by a lack of isolation.

By finding a portion of each antenna which can be placed close to the second antenna across multiple frequency resonances, the closely spaced antennas may operate with sufficient isolation. Both antennas may have a portion which (for critical resonances/standing wave current distributions) can be co-located or reside next to one another so that very little coupling occurs. While there may be some coupling, it is possible to minimize the coupling with various exemplary embodiments.

Various exemplary embodiments relate to portable electronic devices having antennas and moreover at least two closely spaced antennas. When two antennas are closely spaced and operate on different frequency bands it is possible that coupling can occur which leads to poor isolation. Isolation between antennas (such as measured by S21, for example) is an essential RF system parameter for defining the validity of an antennae arrangement. Weak isolation occurs when the resonance of one antenna overlaps or is too close in frequency with the operational frequency of another antenna. At the resonant frequency, the first antenna may generate a standing wave that causes electric field maxima at an area next to the other antenna. This causes strong electric field coupling between the antennas and results in poor isolation.

Conventionally, antennas are kept far enough apart so that the isolation between them is at an acceptable level. However, the desire to both reduce the size of devices and to include additional components limits the amount of space available. Various exemplary embodiments provide a cost effective and easily implemented solution which allows closely spaced antennas to have sufficient isolation (such as having an S21 isolation value of less than −15 dB). By carefully selecting a physical antenna structure, the resonant frequencies (and thus the corresponding electric field and magnetic field) can be limited to proper frequencies. The physical antenna structure may be influenced by controlling the overall length of the antenna, the length and width of any meandering sections, the number of meandering sections and the width of the antenna trace.

Various exemplary embodiments include antenna radiators which have been selected so that their critical resonance modes do not have standing waves causing electric field maxima in areas near the other antenna(s) at or near operational frequencies of the other antenna. The operational frequency of an antenna is the frequency (or frequency range) at which the antenna is configured to operate. Acceptable isolation between closely spaced antennas is obtained by controlling the electric field maxima. Depending on the radio protocols being used for the different antennas, the acceptable isolation may be of the order of −10 dB or even −15 db (S21) at a given frequency or across a frequency band.

Figure 29:
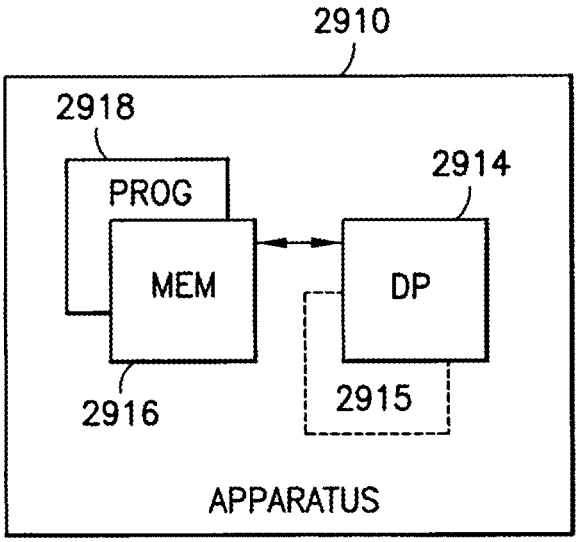
FIG. 29 shows a simplified block diagram of exemplary electronic devices that are suitable for use in practicing various exemplary embodiments.

In FIG. 29, an apparatus 2910 includes a controller, such as a computer or a data processor (DP) 2914, and a computer-readable memory medium embodied as a memory (MEM) 2916 that stores a program of computer instructions (PROG) 2918. The apparatus 2910 may be embodied in a portable electronic device such as a laptop computer, mobile phone, cell phone, digital camera, tablet computer, etc. for example.

The PROG 2918 is assumed to include program instructions that, when executed by the associated DP 2914, enable the device to operate in accordance with exemplary embodiments. That is, various exemplary embodiments may be implemented at least in part by computer software executable by the DP 2914 of the apparatus 2910, or by hardware, or by a combination of software and hardware (and firmware).

The apparatus 2910 may also include dedicated processors, for example antenna arrangement modeler 2915.

The computer readable MEM 2916 may be of any type suitable to the local technical environment and may be implemented using any suitable data storage technology, such as semiconductor based memory devices, flash memory, magnetic memory devices and systems, optical memory devices and systems, fixed memory and removable memory. The DP 2914 may be of any type suitable to the local technical environment, and may include one or more of general purpose computers, special purpose computers, microprocessors, digital signal processors (DSPs) and processors based on a multicore processor architecture, as non-limiting examples.

Based on the foregoing it should be apparent that various exemplary embodiments provide a method, apparatus and computer program(s) to provide an antenna arrangement.

Figure 30:
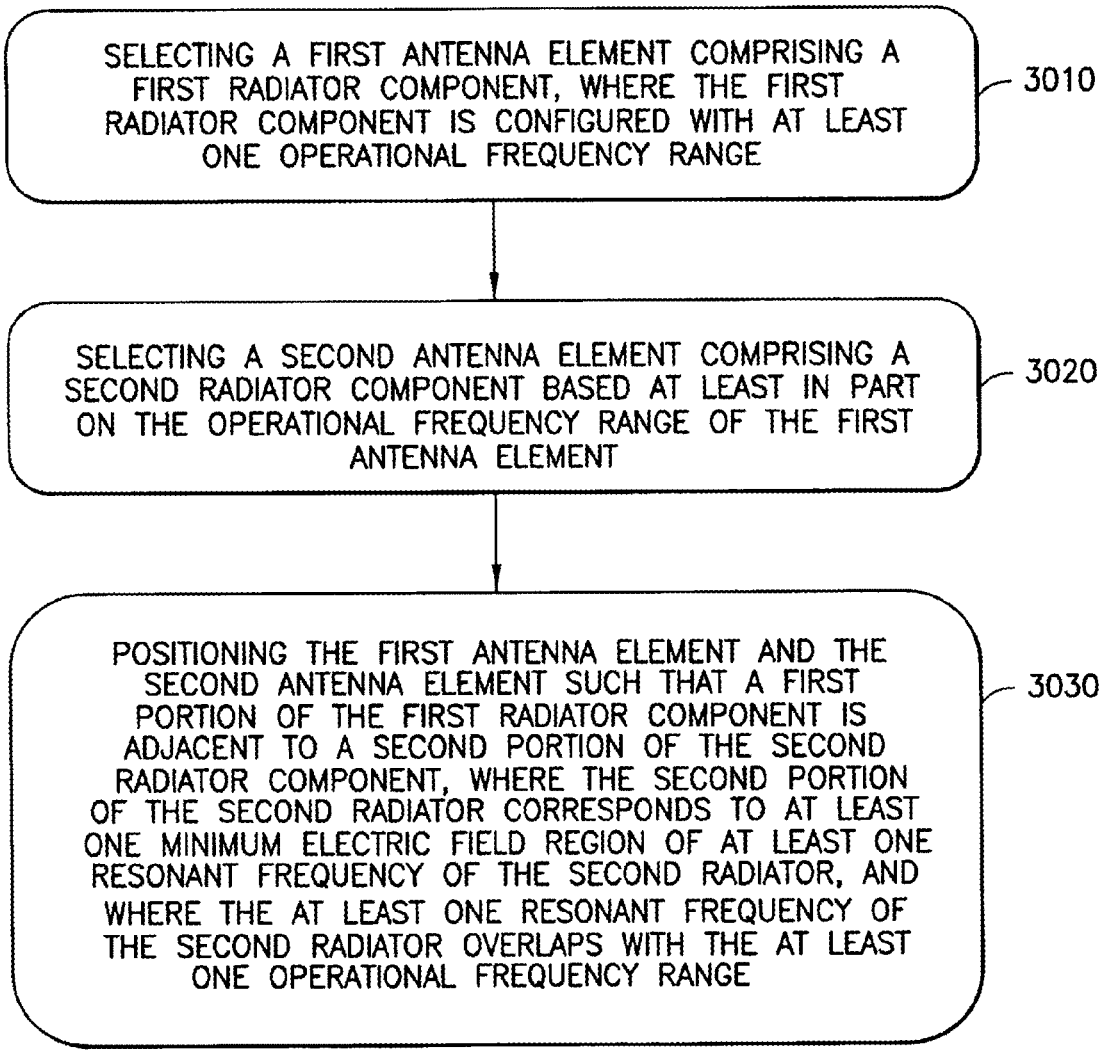
FIG. 30 is a logic flow diagram that illustrates the operation of an exemplary method, and a result of execution of computer program instructions embodied on a computer readable memory, in accordance with various exemplary embodiments.

FIG. 30 is a logic flow diagram that illustrates the operation of a method, and a result of execution of computer program instructions (such as PROG 2918 for example), in accordance with exemplary embodiments. In accordance with these exemplary embodiments a method performs, at Block 3010, selecting a first antenna element comprising a first radiator component, where the first radiator component is configured with at least one operational frequency range. At Block 3020, the method performs selecting a second antenna element comprising a second radiator component based at least in part on the operational frequency range of the first antenna element. The method performs positioning the first antenna element and the second antenna element such that a first portion of the first radiator component is adjacent to a second portion of the second radiator component at Block 3030. The second portion of the second radiator corresponds to at least one minimum electric field region of at least one resonant frequency of the second radiator. The at least one resonant frequency of the second radiator overlaps with the at least one operational frequency range.

Additionally, when selecting the second antenna element, the method may include avoiding maximums of electric fields for other resonant frequencies of the second antenna element in the second portion. Likewise, when positioning the first antenna element and the second antenna element, the first antenna element is positioned so as to avoid maximums of electric fields of resonant frequencies of the first antenna element being in the first portion.

The various blocks shown in FIG. 30 may be viewed as method steps, and/or as operations that result from operation of computer program code, and/or as a plurality of coupled logic circuit elements constructed to carry out the associated function(s). In further exemplary embodiments, various blocks may be performed in any order and/or omitted.

In general, the various exemplary embodiments may be implemented in hardware or special purpose circuits, software, logic or any combination thereof. For example, some aspects may be implemented in hardware, while other aspects may be implemented in firmware or software which may be executed by a controller, microprocessor or other computing device, although not limited thereto. While various aspects of the exemplary embodiments may be illustrated and described as block diagrams, flow charts, or using some other pictorial representation, it is well understood that these blocks, apparatus, systems, techniques or methods described herein may be implemented in, as nonlimiting examples, hardware, software, firmware, special purpose circuits or logic, general purpose hardware or controller or other computing devices, or some combination thereof.

It should thus be appreciated that at least some aspects of the exemplary embodiments may be practiced in various components such as integrated circuit chips and modules, and that the exemplary embodiments may be realized in an apparatus that is embodied as an integrated circuit. The integrated circuit, or circuits, may comprise circuitry (as well as possibly firmware) for embodying at least one or more of a data processor or data processors, a digital signal processor or processors, baseband circuitry and radio frequency circuitry that are configurable so as to operate in accordance with the exemplary embodiments.

An exemplary embodiment provides an apparatus for antenna arrangement isolation. The apparatus includes a first antenna element having a first radiator component and a second antenna element having a second radiator component. A first portion of the first radiator component is adjacent to a second portion of the second radiator component. The first portion of the first radiator component is located at a separation distance from the second portion of the second radiator component. The second radiator component is configured with at least one operational frequency range. The first portion of the first radiator corresponds to at least one minimum electric field region of at least one resonant frequency of the first radiator. The at least one resonant frequency of the first radiator overlaps with the at least one operational frequency range.

In a further embodiment of the apparatus above, the separation distance is approximately 2 mm. The separation distance is the shortest distance between any portion of the first radiator component and any portion of the second radiator component.

In another embodiment of any one of the apparatus above, the first antenna element is a multi-band antenna element.

In a further embodiment of any one of the apparatus above, the second antenna element is a multi-band antenna element.

In another embodiment of any one of the apparatus above, an isolation between the first antenna element and the second antenna element is at least −15 dB.

In a further embodiment of any one of the apparatus above, the first antenna element is a mobile television antenna. The first antenna element may have a primary resonant frequency between 550 MHz and 650 MHz. The first antenna element may have resonant frequencies at 605 MHz, 1,330 MHz, 2,160 MHz and 2,860 MHz.

In another embodiment of any one of the apparatus above, the second antenna element is a cellular antenna. The second antenna element may have resonant frequencies at 886 MHz, 1,720 MHz and 2,010 MHz. The cellular antenna may include a parasitic radiator and a single feed monopole radiator. The second portion of the second radiator component may be a portion of the single feed monopole radiator.

In a further embodiment of any one of the apparatus above, the first radiator component has a length, L. The first portion comprises a point located approximately L/2 from a feed point of the first radiator component. For example, L may be approximately 63 mm and the first portion may be located approximately 35 mm from the feed point.

In another embodiment of any one of the apparatus above, the second radiator component has a length, L. The second portion comprises a point located approximately L/2 from a feed point of the first radiator component. For example, L may be approximately 137 mm and the first portion may be located approximately 75 mm from the feed point.

In a further embodiment of any one of the apparatus above, the first antenna element and the second antenna element share a ground plane.

In another embodiment of any one of the apparatus above, the first antenna element is a mobile television antenna.

In a further exemplary embodiment provides a method for providing a closely spaced antenna arrangement. The method includes selecting a first antenna element comprising a first radiator component. The first radiator component is configured with at least one operational frequency range. The method also includes selecting a second antenna element comprising a second radiator component based at least in part on the operational frequency range of the first antenna element. The method also includes positioning the first antenna element and the second antenna element such that a first portion of the first radiator component is adjacent to a second portion of the second radiator component. The second portion of the second radiator corresponds to at least one minimum electric field region of at least one resonant frequency of the second radiator. The at least one resonant frequency of the second radiator overlaps with the at least one operational frequency range.

In another embodiment of the method above, the first portion of the first radiator component is located at a separation distance of approximately 2-15 mm from the second portion of the second radiator component.

In a further embodiment of any one of the methods above, the first antenna element is a multi-band antenna element and the second antenna element is a multi-band antenna element.

In another embodiment of any one of the methods above, the operational frequency range is a cellular communication frequency range and the second antenna element is a mobile television antenna.

In a further embodiment of any one of the methods above, the first radiator component has a length, L. The first portion comprises a point located approximately L/2 from a feed point of the first radiator component. For example, L may be approximately 63 mm and the first portion may be located approximately 35 mm from the feed point.

In another embodiment of any one of the methods above, the second radiator component has a length, L. The second portion comprises a point located approximately L/2 from a feed point of the first radiator component. For example, L may be approximately 137 mm and the first portion may be located approximately 75 mm from the feed point.

In a further exemplary embodiment provides an apparatus for providing a closely spaced antenna arrangement. The apparatus includes at least one processor and at least one memory storing computer program code. The at least one memory and the computer program code are configured to, with the at least one processor, cause the apparatus to perform actions. The actions include selecting a first antenna element comprising a first radiator component. The first radiator component is configured with at least one operational frequency range. The actions also include selecting a second antenna element comprising a second radiator component based at least in part on the operational frequency range of the first antenna element. The actions also include positioning the first antenna element and the second antenna element such that a first portion of the first radiator component is adjacent to a second portion of the second radiator component. The second portion of the second radiator corresponds to at least one minimum electric field region of at least one resonant frequency of the second radiator. The at least one resonant frequency of the second radiator overlaps with the at least one operational frequency range.

In another embodiment of the apparatus above, the first portion of the first radiator component is located at a separation distance of approximately 2-15 mm from the second portion of the second radiator component.

In a further embodiment of any one of the apparatus above, the first antenna element is a multi-band antenna element and the second antenna element is a multi-band antenna element.

In another embodiment of any one of the apparatus above, the operational frequency range is a cellular communication frequency range and the second antenna element is a mobile television antenna.

In a further embodiment of any one of the apparatus above, the first radiator component has a length, L. The first portion comprises a point located approximately L/2 from a feed point of the first radiator component. For example, L may be approximately 63 mm and the first portion may be located approximately 35 mm from the feed point.

In another embodiment of any one of the apparatus above, the second radiator component has a length, L. The second portion comprises a point located approximately L/2 from a feed point of the first radiator component. For example, L may be approximately 137 mm and the first portion may be located approximately 75 mm from the feed point.

In a further exemplary embodiment provides a computer readable medium for providing a closely spaced antenna arrangement. The computer readable medium (such as MEM 2916 for example) is tangibly encoded with a computer program (such as PROG 2918 for example) executable by a processor (such as DP 2914 for example) to perform actions. The actions include selecting a first antenna element comprising a first radiator component. The first radiator component is configured with at least one operational frequency range. The actions also include selecting a second antenna element comprising a second radiator component based at least in part on the operational frequency range of the first antenna element. The actions also include positioning the first antenna element and the second antenna element such that a first portion of the first radiator component is adjacent to a second portion of the second radiator component. The second portion of the second radiator corresponds to at least one minimum electric field region of at least one resonant frequency of the second radiator. The at least one resonant frequency of the second radiator overlaps with the at least one operational frequency range.

In another embodiment of the computer readable medium above, the first portion of the first radiator component is located at a separation distance of approximately 2 mm from the second portion of the second radiator component.

In a further embodiment of any one of the computer readable media above, the first antenna element is a multi-band antenna element and the second antenna element is a multi-band antenna element.

In another embodiment of any one of the computer readable media above, the operational frequency range is a cellular communication frequency range and the second antenna element is a mobile television antenna.

In a further embodiment of any one of the computer readable media above, the first radiator component has a length, L. The first portion comprises a point located approximately L/2 from a feed point of the first radiator component. For example, L may be approximately 63 mm and the first portion may be located approximately 35 mm from the feed point.

In another embodiment of any one of the computer readable media above, the second radiator component has a length, L. The second portion comprises a point located approximately L/2 from a feed point of the first radiator component. For example, L may be approximately 137 mm and the first portion may be located approximately 75 mm from the feed point.

In a further exemplary embodiment of any one of the computer readable media above, the computer readable medium is a storage medium.

In another exemplary embodiment of any one of the computer readable media above, the computer readable medium is a non-transitory computer readable medium (e.g., CD-ROM, RAM, flash memory, etc.).

In a further exemplary embodiment provides an apparatus for providing a closely spaced antenna arrangement. The apparatus includes means for selecting a first antenna element comprising a first radiator component. The first radiator component is configured with at least one operational frequency range. The apparatus also includes means for selecting a second antenna element comprising a second radiator component based at least in part on the operational frequency range of the first antenna element. The apparatus also includes means for positioning the first antenna element and the second antenna element such that a first portion of the first radiator component is adjacent to a second portion of the second radiator component. The second portion of the second radiator corresponds to at least one minimum electric field region of at least one resonant frequency of the second radiator. The at least one resonant frequency of the second radiator overlaps with the at least one operational frequency range.

In another embodiment of the apparatus above, the first portion of the first radiator component is located at a separation distance of approximately 2-15 min from the second portion of the second radiator component.

In a further embodiment of any one of the apparatus above, the first antenna element is a multi-band antenna element and the second antenna element is a multi-band antenna element.

In another embodiment of any one of the apparatus above, the operational frequency range is a cellular communication frequency range and the second antenna element is a mobile television antenna.

In a further embodiment of any one of the methods above, the first radiator component has a length, L. The first portion comprises a point located approximately L/2 from a feed point of the first radiator component. For example, L may be approximately 63 mm and the first portion may be located approximately 35 mm from the feed point.

In another embodiment of any one of the methods above, the second radiator component has a length, L. The second portion comprises a point located approximately L/2 from a feed point of the first radiator component. For example, L may be approximately 137 mm and the first portion may be located approximately 75 mm from the feed point.

Various modifications and adaptations to the foregoing exemplary embodiments may become apparent to those skilled in the relevant arts in view of the foregoing description, when read in conjunction with the accompanying drawings. However, any and all modifications will still fall within the scope of the non-limiting and exemplary embodiments.

It should be noted that the terms "connected," "coupled," or any variant thereof, mean any connection or coupling, either direct or indirect, between two or more elements, and may encompass the presence of one or more intermediate elements between two elements that are "connected" or "coupled" together. The coupling or connection between the elements can be physical, logical, or a combination thereof. As employed herein two elements may be considered to be "connected" or "coupled" together by the use of one or more wires, cables and/or printed electrical connections, as well as by the use of electromagnetic energy, such as electromagnetic energy having wavelengths in the radio frequency region, the microwave region and the optical (both visible and invisible) region, as several non-limiting and non-exhaustive examples. It should also be noted that the word "antenna" or any variant thereof, means that at least one of voice communication, data communication, and power transfer is possible by said antenna over near, far and both near and far fields. This includes such systems like wireless power consortium (Qi), radio frequency identification (RFID), near field communication (NFC), and other wireless power transfer systems, as non-limiting examples of inductive coupling and/or near field antennas. In addition this applies also to far field antenna systems such as those used for Bluetooth, wireless local area networks (WLAN), and cellular bands, as non-limiting examples.

It should be appreciated that in an example embodiment, that either one or both of the first and second antennas could be any one of, and not limited to, an inverted-L antenna (ILA), inverted-F antenna (IFA), planar inverted-L antenna (PILA), planar inverted-F antenna (PIFA), dipole antenna, folded dipole antenna, folded monopole antenna, loop antenna, half loop antenna, folded loop antenna, dual loop antenna, patch antenna, slot antenna, notch antenna, helical antenna, aperture antenna, horn antenna or any combination of these antenna types. At least one of the first and second antennas could also include at least one parasitic element and/or matching circuit.

Furthermore, some of the features of the various non-limiting and exemplary embodiments may be used to advantage without the corresponding use of other features. As such, the foregoing description should be considered as merely illustrative of the principles, teachings and exemplary embodiments, and not in limitation thereof.

What is claimed is:

1. An apparatus comprising:

a first antenna element comprising a first radiator component; and a second antenna element comprising a second radiator component, wherein a first portion of the first radiator component is adjacent to a second portion of the second radiator component, wherein the second radiator component is configured with at least one operational frequency range, wherein the first portion of the first radiator component corresponds to at least one minimum electric field region of at least one resonant frequency of the first radiator component, and wherein the at least one resonant frequency of the first radiator component does not exceed the upper bound of the at least one operational frequency range by more than 5% of the operational frequency range and does not fall short of the lower bound of the at least one operational frequency range by more than 5% of the operational frequency range.

2. The apparatus of claim 1, wherein the at least one resonant frequency of the first radiator component overlaps with the operational frequency range.

3. The apparatus of claim 1, wherein the first antenna element is separate from the second antenna element.

4. The apparatus of claim 3, wherein each of the first and second antennas is a multi-band antenna, and wherein each of the first antenna and the second antenna resonates in more than one frequency band.

5. The apparatus of claim 1, wherein the first antenna element is longer than the second antenna element.

6. The apparatus of claim 1, wherein the first antenna element includes one or more meandered portions.

7. The apparatus of claim 6, wherein the one or more meandered portions comprises a non-right angle turn.

8. The apparatus of claim 1, wherein the first antenna comprises a first feed and the second antenna comprises a second feed, and the first feed is located next to the second feed.

9. A module comprising the apparatus of claim 1.

10. An integrated circuit comprising the apparatus of claim 1.

11. A portable electronic device comprising the apparatus of claim 1.

12. The portable electronic device of claim 11, wherein the portable electronic device is a mobile wireless communications device.

13. A method comprising:

selecting a first antenna element comprising a first radiator component, where the first radiator component is configured with at least one operational frequency range;

selecting a second antenna element comprising a second radiator component based at least in part on the operational frequency range of the first antenna element; and positioning the first antenna element and the second antenna element such that a first portion of the first radiator component is adjacent to a second portion of the second radiator component, wherein the second portion of the second radiator corresponds to at least one minimum electric field region of at least one resonant frequency of the second radiator, and wherein the at least one resonant frequency of the first radiator component does not exceed the upper bound of the at least one operational frequency range by more than 5% of the operational frequency range and does not falls short of the lower bound of the at least one operational frequency range by more than 5% of the operational frequency range.

14. The method of claim 13, wherein the resonant frequency at least one resonant frequency of the first radiator component overlaps with the operational frequency range.

15. A mobile wireless communications device, comprising:

a first antenna element comprising a first radiator component; and a second antenna element comprising a second radiator component, where a first portion of the first radiator component is adjacent to a second portion of the second radiator component, wherein the second radiator component is configured with at least one operational frequency range, wherein the first portion of the first radiator component corresponds to at least one minimum electric field region of at least one resonant frequency of the first radiator component, and wherein the at least one resonant frequency of the first radiator component does not exceed the upper bound of the at least one operational frequency range by more than 5% of the operational frequency range and does not fall short of the lower bound of the at least one operational frequency range by more than 5% of the total operational frequency range.

16. The mobile wireless communications device of claim 15, wherein at least one resonant frequency of the first radiator component overlaps with the operational frequency range.

* * * * *